US010101042B2

(12) United States Patent
Kim et al.

(10) Patent No.: US 10,101,042 B2
(45) Date of Patent: Oct. 16, 2018

(54) AIR CONDITIONER INCLUDING A HANDLE AND METHOD OF CONTROLLING THE SAME

(71) Applicant: SAMSUNG ELECTRONICS CO., LTD., Suwon-si, Gyeonggi-do (KR)

(72) Inventors: Jung Ho Kim, Suwon-si (KR); Yong Hyun Kil, Suwon-si (KR); Sung-June Cho, Suwon-si (KR); Joon-Ho Yoon, Suwon-si (KR); Kil Hong Song, Seoul (KR); Dong Woon Kang, Seongnam-si (KR); Eun-Jung Kang, Seoul (KR); Eom Ji Jang, Anyang-si (KR); Ina Chae, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 709 days.

(21) Appl. No.: 14/660,016

(22) Filed: Mar. 17, 2015

(65) Prior Publication Data

US 2015/0267929 A1 Sep. 24, 2015

(30) Foreign Application Priority Data

Mar. 18, 2014 (KR) ..... 10-2014-0031484
Jun. 9, 2014 (KR) ..... 10-2014-0069740

(51) Int. Cl.
*F24F 13/22* (2006.01)
*F24F 5/00* (2006.01)
(Continued)

(52) U.S. Cl.
CPC ..... *F24F 5/001* (2013.01); *F24F 1/025* (2013.01); *F24F 11/30* (2018.01); *F24F 13/222* (2013.01); *F24F 2013/225* (2013.01)

(58) Field of Classification Search
CPC ..... F24F 1/025; F24F 13/222; F24F 13/224; F24F 2013/225; F24F 2013/227
See application file for complete search history.

(56) References Cited

U.S. PATENT DOCUMENTS 2,116,974 A * 5/1938 Keighley ..... F24F 1/025 417/208
2,793,510 A * 5/1957 Komroff ..... F24F 13/224 62/280

(Continued)

FOREIGN PATENT DOCUMENTS

EP 1 693 630 B2 8/2006
WO 2013/081132 A1 6/2013

OTHER PUBLICATIONS

European Search Report dated Dec. 7, 2016 issued in corresponding European Patent Application 15159489.2.

(Continued)

*Primary Examiner* — Jonathan Bradford
(74) *Attorney, Agent, or Firm* — Staas & Halsey LLP

(57) ABSTRACT

Disclosed herein is an air conditioner that is designed to include a first space in which an evaporator is disposed and a second space in which a condenser is disposed and which is divided from the first space. An outdoor unit and an indoor unit are integrally formed, and thus it is easy to move the air conditioner. A structure and disposition of a heat exchanger are improved, and thus heat exchange efficiency is improved. Operations of a cooling mode and a dehumidifying mode are possible.

11 Claims, 31 Drawing Sheets

(51) Int. Cl.
*F24F 11/30* (2018.01)
*F24F 1/02* (2011.01)

(56) References Cited

U.S. PATENT DOCUMENTS

| | | | | |
|---|---|---|---|---|
| 3,635,046 | A * | 1/1972 | Sato | F24F 1/022 62/173 |
| 5,117,652 | A * | 6/1992 | Takeuchi | F24F 1/025 62/291 |
| 5,638,695 | A * | 6/1997 | Kamio | F24F 5/0007 165/134.1 |
| 6,067,812 | A * | 5/2000 | Bushnell | F24F 1/027 62/279 |
| 7,231,777 | B1 * | 6/2007 | Arnold | F24F 1/025 62/259.3 |
| 2004/0045304 | A1 * | 3/2004 | Park | F24F 1/022 62/183 |

OTHER PUBLICATIONS

Partial European Search Report dated Jul. 30, 2015 issued in corresponding European Patent Application 15159489.2.

* cited by examiner (A)

(B)

AIR CONDITIONER INCLUDING A HANDLE AND METHOD OF CONTROLLING THE SAME

CROSS-REFERENCE TO RELATED APPLICATIONS

This application claims the benefit of Korean Patent Application Nos. 10-2014-0031484 and 10-2014-0069740, filed on Mar. 18, 2014 and Jun. 9, 2014, respectively, in the Korean Intellectual Property Office, the disclosure of which is incorporated herein by reference.

BACKGROUND

1. Field

One or more embodiments of the present disclosure relate to an air conditioner and a method of controlling the same and, more particularly, to an integral air conditioner in which an outdoor unit and an indoor unit are combined and a method of controlling the same.

2. Description of the Related Art

Air conditioners are devices for controlling suitable conditions for human activities such as a temperature, humidity, an air stream, air distribution, etc. using a refrigeration cycle and simultaneously removing foreign materials such as dust in the air. Main components constituting the refrigeration cycle include a compressor, a condenser, an evaporator, a ventilation fan, and so on.

The air conditioners are classified as split air conditioners in which an indoor unit and an outdoor unit are separately installed, and integral air conditioners in which an indoor unit and an outdoor unit are installed together in one cabinet.

The integral air conditioner is generally installed across a wall or a window in such a manner that the indoor unit portion is directed indoors and the outdoor unit portion is directed outdoors.

The integral air conditioner is bulky, and must occupy a part of the wall or window, which has a negative effect from an aesthetic viewpoint.

SUMMARY

Therefore, it is an aspect of the present disclosure to provide an air conditioner that is easily installed and can be changed in position and place as needed, and a method of controlling the same.

It is another aspect of the present disclosure to provide an air conditioner that provides cooled or heated air for a user without communicating with an outdoor area divided from an indoor area, and a method of controlling the same.

It is yet another aspect of the present disclosure to efficiently control power consumption of a power supply in order to more conveniently use an air conditioner provided for easy installation and movement.

Additional aspects of the disclosure will be set forth in part in the description which follows and, in part, will be obvious from the description, or may be learned by practice of the disclosure.

According to an aspect of the present disclosure, there is provided an air conditioner which includes: a housing including a first space in which a first suction port and a first discharge port are formed, and a second space in which a second suction port and a second discharge port are formed and which is divided from the first space; a compressor provided to compress a refrigerant in the housing; a condenser that is provided in the second space and condenses the refrigerant compressed by the compressor into a liquid phase; an expansion unit expanding the refrigerant condensed by the condenser in a low pressure state; an evaporator that is provided in the first space and evaporates the refrigerant discharged from the expansion unit to exchange heat with ambient air; a water tank in which a condensate is stored; and a tray assembly that discharges the condensate generated from the evaporator to the condenser in a cooling mode and discharges the condensate generated from the evaporator to the water tank in a dehumidifying mode.

Here, the tray assembly may include: a first tray having a water storage space in which the condensate generated from the evaporator is stored; a second tray provided to receive the condensate from the first tray and to discharge the received condensate to the condenser; and a third tray provided below the condenser such that the condensate passing through the condenser is collected.

Further, the first tray may be formed below the evaporator such that one side thereof directed to the evaporator has the shape of an open water conduit, and may be provided such that the condensate generated by the heat exchange between the evaporator and the air introduced from an outside is collected on the first tray. The second tray may be disposed above the condenser, and be provided to have a supply space in which the condensate delivered from the first tray is stored. The third tray may be provided to have a discharge space such that the condensate passing through the condenser is collected.

Further, the air conditioner may further include an auxiliary member provided between the second tray and the condenser such that the condensate discharged from the second tray is uniformly supplied to the condenser.

Here, the auxiliary member may be provided to cover an upper portion of the condenser, and be provided between the condenser and the second tray under pressure so as to be able to smoothly discharge the condensate to the condenser.

Further, the air conditioner may further include a handle provided at an upper portion of the main body so as to allow the air conditioner to move, and the condenser and the evaporator may have the center of gravity disposed below the handle.

Further, the air conditioner may further include: a first ventilation fan that is provided in the first space and is disposed between the first discharge port and the evaporator; and a second ventilation fan that is provided in the second space and is disposed between the second discharge port and the condenser. The first discharge port, the first ventilation fan, the evaporator, and the first suction port may be disposed in a row in a forward/backward direction of the housing, and the second discharge port, the second ventilation fan, the condenser, and the second suction port may be disposed in a row in the forward/backward direction of the housing.

Here, the first and second discharge ports may be disposed in opposite directions in a forward/backward direction of the housing.

Further, the first space may include an evaporation channel extending from the first suction port to the first discharge port, and the second space may include a condensation channel extending from the second suction port to the second discharge port. The evaporation channel and the condensation channel may extend in opposite directions.

Further, the condenser may be disposed below the evaporator so as to be spaced apart from each other at a given angle in a leftward/rightward direction of the housing.

The air conditioner may include a control unit that is disposed in the second space and is provided for electrical control of the air conditioner. The second space may include a condensation channel extending from the second suction port, into which air is introduced from an outside, to the second discharge port to which the air in the second space is discharged. The condensation channel may include a first condensation channel that passes through the second suction port, the condenser, the second ventilation fan, and the second discharge port, and a second condensation channel that passes through the second suction port, the control unit, the second ventilation fan, and the second discharge port.

According to another aspect of the present disclosure, there is provided a method of controlling an air conditioner including a compressor, a condenser, an expansion unit, and an evaporator, the method including: operating a first ventilation fan that discharges air around the evaporator and a second ventilation fan whose rotational speed cooperates with that of the first ventilation fan in order to discharge air around the condenser at a preset air volume; and variably controlling an operating frequency of the compressor according to an air volume of the first ventilation fan such that power input of the compressor is equal to or less than a preset value.

Here, the method of controlling the air conditioner may include providing multiple setting air volumes so as to operate the first ventilation fan at different air volumes, and previously setting characteristic operating frequencies so as to correspond to the respective multiple setting air volumes.

Further, the method of controlling the air conditioner may further include causing the air volume of the first ventilation fan to be set by selection of a user.

According to yet another aspect of the present disclosure, there is provided a method of controlling an air conditioner including a compressor, a condenser, an expansion unit, and an evaporator, the method including: operating a first ventilation fan that discharges air around the evaporator and a second ventilation fan whose rotational speed cooperates with that of the first ventilation fan in order to discharge air around the condenser at a preset air volume; operating the compressor at an operating frequency corresponding to an air volume of the first ventilation fan; monitoring whether the air volume of the first ventilation fan is changed; and resetting the operating frequency of the compressor according to a change in the air volume of the first ventilation fan when the air volume of the first ventilation fan is changed.

Here, the method may include: providing multiple setting air volumes so as to operate the first ventilation fan at different air volumes; and previously setting characteristic operating frequencies so as to correspond to the respective multiple setting air volumes.

Further, the operating frequency corresponding to the air volume of the first ventilation fan may be set so that power input of the compressor is equal to or less than a preset value when the compressor is operated at an operating frequency corresponding to the setting air volume.

Further, the method may further include causing the air volume of the first ventilation fan to be set by selection of a user.

Further, the air volume of the first ventilation fan may be changed in such a manner that an actual air volume of the first ventilation fan is changed in a state in which setting of the air volume is not changed.

Also, the change in the air volume of the first ventilation fan may be detected by a change in discharge temperature of the compressor.

Further, when the discharge temperature of the compressor is lowered, it may be determined that the power input of the compressor is increased. When the discharge temperature of the compressor is raised, it may be determined that the power input of the compressor is reduced.

According to still yet another aspect of the present disclosure, there is provided a method of controlling an air conditioner equipped with multiple power consumption components including a first ventilation fan that discharges air around an evaporator and a second ventilation fan whose rotational speed cooperates with that of the first ventilation fan in order to discharge air around a condenser, the method including: invariably operating the first ventilation fan at a preset air volume; and variably controlling operating factors of the power consumption components other than the first and second ventilation fans among the multiple power consumption components such that a power consumption amount of the air conditioner is equal to or less than a preset value.

Here, the multiple power consumption components may include a variable capacity compressor.

Further, the variably controlling of the operating factors of the power consumption components may include variably controlling an operating frequency of the compressor.

Further, the method may further include: providing multiple setting air volumes so as to operate the first ventilation fan at different air volumes; and previously setting characteristic operating frequencies so as to correspond to the respective multiple setting air volumes.

Further, the characteristic operating frequencies may be set so that power input of the compressor is equal to or less than a preset value when the compressor is operated at an operating frequency corresponding to the setting air volume.

Also, the method may further include causing the air volume of the first ventilation fan to be set by selection of a user.

According to still yet another aspect of the present disclosure, there is provided an air conditioner, which includes: a compressor; a condenser; an expansion unit; an evaporator; a first ventilation fan that sends air of the evaporator; and a control unit that operates the first ventilation fan that discharges air around the evaporator and a second ventilation fan whose rotational speed cooperates with that of the first ventilation fan in order to discharge air around the condenser at a preset air volume, and variably controls an operating frequency of the compressor according to an air volume of the first ventilation fan such that power input of the compressor is equal to or less than a preset value.

Here, the air conditioner may include multiple setting air volumes provided to operate the first ventilation fan at different air volumes, and characteristic operating frequencies previously set to correspond to the respective multiple setting air volumes.

Further, the characteristic operating frequencies may be set so that power input of the compressor is equal to or less than a preset value when the compressor is operated at an operating frequency corresponding to the setting air volume.

In addition, the air conditioner may further include an air volume setting unit provided such that a user sets the air volume of the first ventilation fan. The air volume of the first ventilation fan may be set by selection of the user from the air volume setting unit.

According to an aspect of the present disclosure, there is provided a method of controlling an air conditioner including a compressor, a condenser, an expansion unit, and an evaporator includes: controlling a ventilation fan for sending air to the evaporator; and changing an operating frequency of the compressor according to intensity of the ventilation fan such that power input of the air conditioner is constant.

According to an aspect of the present disclosure, an air conditioner may include a housing comprising a first space in which a first suction port and a first discharge port are formed, and a second space in which a second suction port and a second discharge port are formed and a partition that prevents air in the first space from being interchanged with air in the second space, wherein the first space is configured to include just components that function as an indoor unit of the air conditioner and the second space is configured to include just components that function as an outdoor unit of the air conditioner.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Reference will now be made in detail to embodiments of the present disclosure with reference to the accompanying drawings.

Figure 1A:
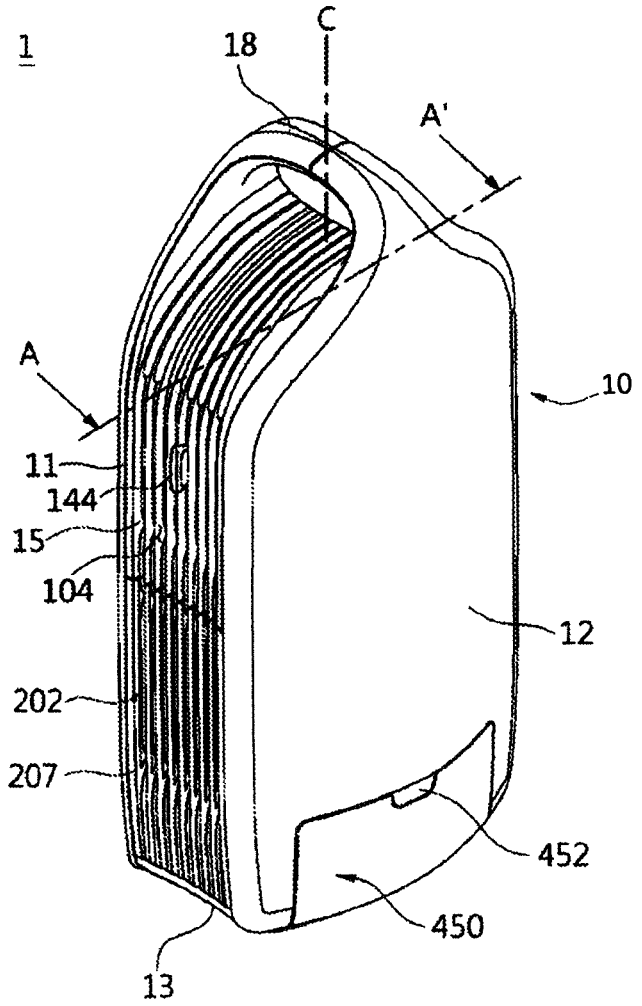
FIGS. 1A and 1B are perspective views of an air conditioner according to an embodiment of the present disclosure.
Figure 1B:
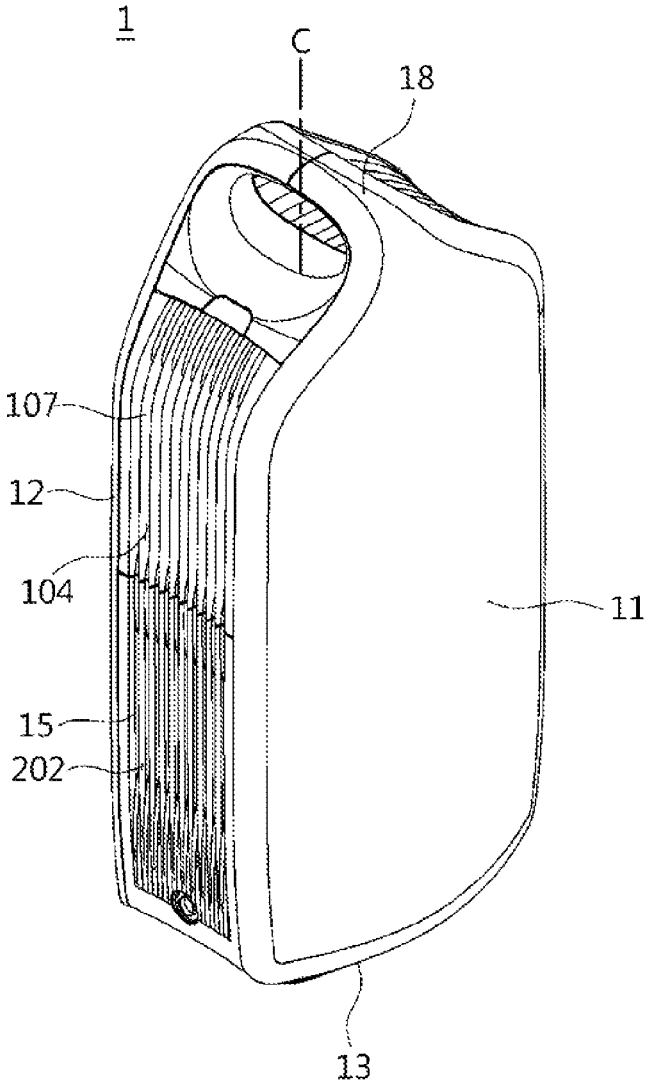
Figure 2A:
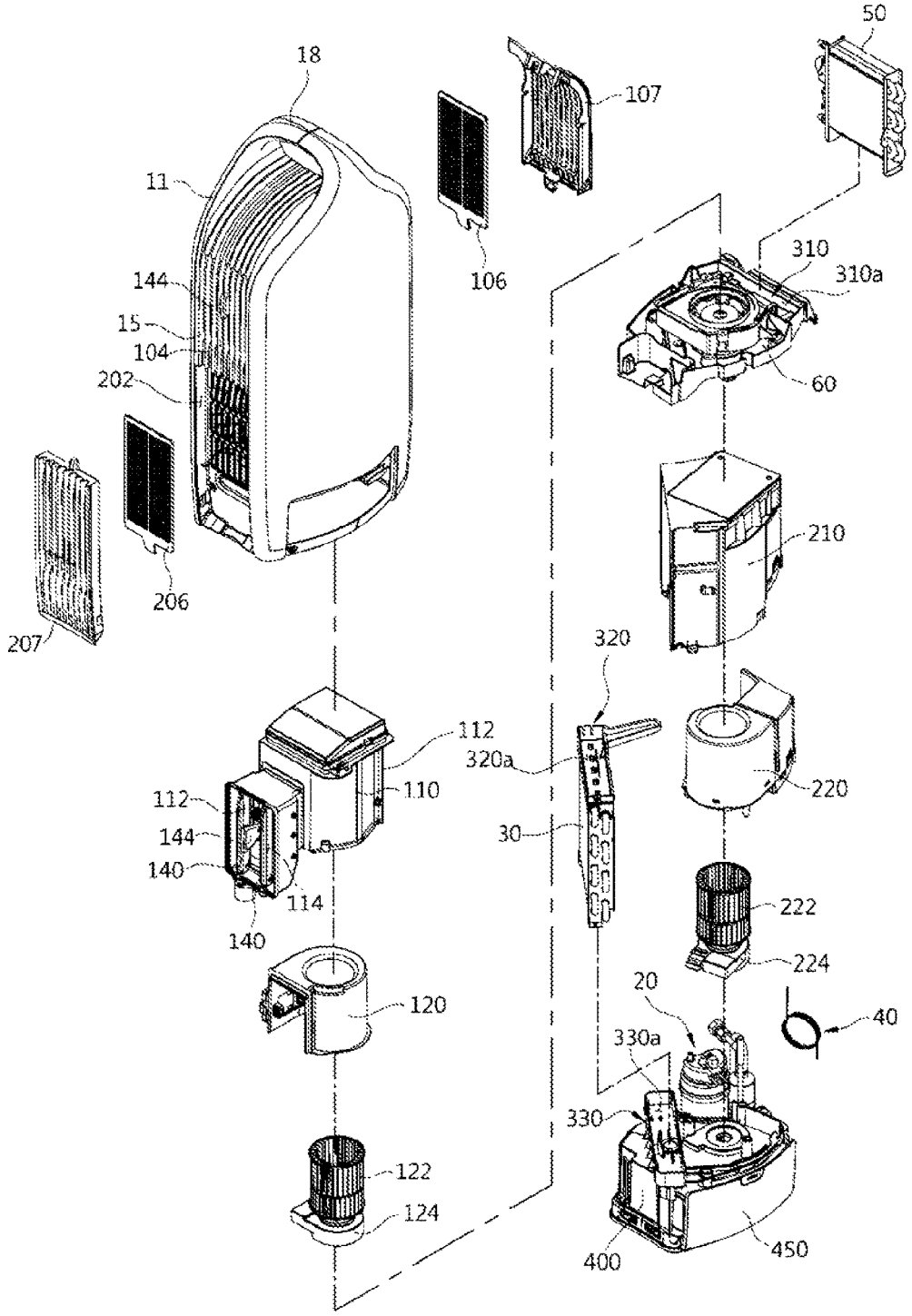
FIG. 2A is an exploded perspective view of the air conditioner according to an embodiment of the present disclosure.
Figure 2B:
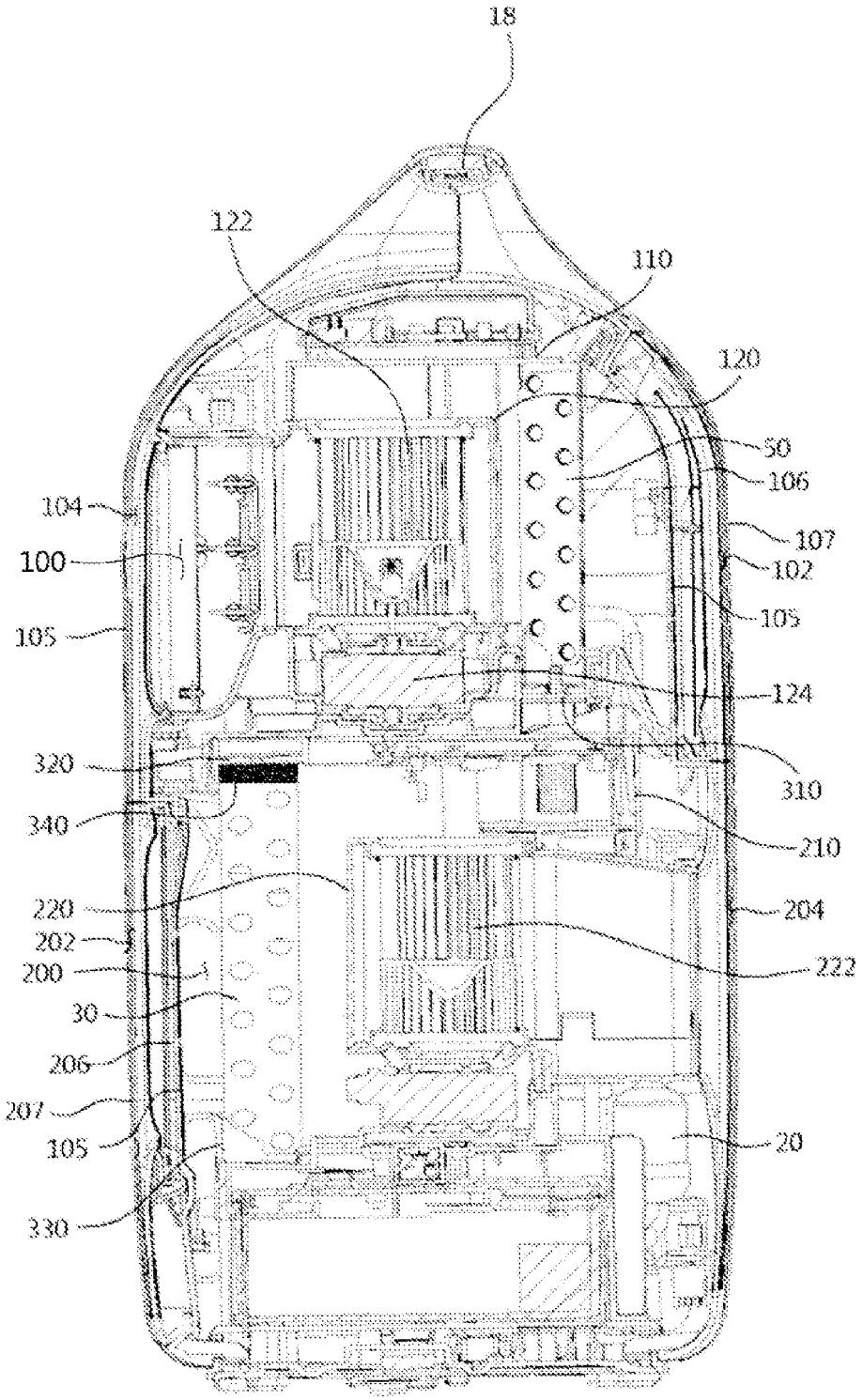
FIG. 2B is a cross-sectional view taken along line A-A' of FIG. 1A.

FIGS. 1A and 1B are perspective views of an air conditioner according to an embodiment of the present disclosure. FIG. 2A is an exploded perspective view of the air conditioner according to an embodiment of the present disclosure, and FIG. 2B is a cross-sectional view taken along line A-A' of FIG. 1A.

A housing 10 is provided to form an external appearance of an air conditioner 1.

The housing 10 includes left and right side panels 11 and 12 forming left and right sides. The housing 10 may be provided with a handle 18 so as to be able to move the air conditioner 1. The handle 18 may be disposed to cross an upper middle of the housing 10 such that the air conditioner 1 can be moved without being inclined. That is, the handle 18 may be provided to be located above the center of gravity of the air conditioner 1. The center of gravity of the air conditioner 1 may be provided to pass along a center line C, and the handle 18 may be disposed on the center line C. The housing 10 is provided with a base 13 at a lower portion thereof such that the air conditioner 1 can be supported from the floor.

The housing 10 may include suction ports 102 and 202 into which air is introduced from the outside, and discharge ports 104 and 204 through which the air inside the housing 10 is discharged.

An interior of the housing 10 may be partitioned into a first space 100 and a second space 200. The first space 100 can be designated as an evaporation space because an evaporator (heat exchanger) 50 is disposed therein, and the second space 200 can be designated as a condensation space because a condenser (heat exchanger) 30 is disposed therein. The first space 100 and the second space 200 may be partitioned, such as by a partition 60. The air in the first space 100 can be prevented from being interchanged with the air in the second space 200 by the partition 60. In detail, the partition 60 may be provided to seal a lower portion of the first space 100 and an upper portion of the second space 200 from each other.

The first space 100 is disposed for components that function as an indoor unit in the split air conditioner 1. The evaporator 50 and a first ventilation fan 122 may be disposed in the first space 100. The second space 200 is disposed for components that function as an outdoor unit in the split air conditioner 1. The condenser 30 and a second ventilation fan 222 may be disposed in the second space 200. However, the present disclosure is not limited to such disposition, and such disposition may be changed. For example, a flow of a refrigerant may be changed such that the first space 100 is disposed for the function of the outdoor unit and the second space 200 is disposed for the function of the indoor unit.

The housing 10 is provided with a first suction port 102 which communicates with the first space 100 and into which the external air is introduced, and a first discharge port 104 through which the air in the first space 100 is discharged. Further, the housing 10 may be provided with a second suction port 202 which communicates with the second space 200 and into which the external air is introduced, and a second discharge port 204 through which the air in the second space 200 is discharged.

Each of the first suction port 102, the first discharge port 104, the second suction port 202, and the second discharge port 204 may be provided with a guide 15 for guiding inflow and outflow of the air. The guides 15 are provided for the first and second suction ports 102 and 202, and the first and second discharge ports 104 and 204 so that they can guide the inflow and outflow of the air and prevent foreign materials from being introduced from the outside into the housing 10.

The first and second suction ports 102 and 202 may be respectively provided with filter members 106 and 206 so as to prevent the foreign materials from being introduced into the housing 10. The filter members 106 and 206 are provided for the first and second suction ports 102 and 202 so as to be able to filter the foreign materials in the air introduced into the housing 10.

In detail, the filter members 106 and 206 may include a first filter member 106 disposed at the first suction port 102, and a second filter member 206 disposed at the second suction port 202. First and second guide covers 107 and 207 may be respectively disposed outside the first and second filter members 106 and 206 such that the first and second filter members 106 and 206 are not exposed to the outside. In detail, the first filter member 106 may be disposed and fixed between the first guide cover 107 and the guide 15, and the second filter member 206 may be disposed and fixed between the second guide cover 207 and the guide 15.

The first suction port 102, the evaporator 50, the first ventilation fan 122, and the first discharge port 104 may be disposed in the first space 100 disposed at an upper portion of the housing 10 in a row, that is, disposed on the same horizontal line within the first space 100. Further, the second suction port 202, the condenser 30, the second ventilation fan 222, and the second discharge port 204 may be disposed in the second space 200 disposed at the lower portion of the housing 10 in a row, that is, on the same horizontal line. This disposition simplifies a channel structure to allow air resistance to be reduced during movement of the air.

The first discharge port 104 and the second discharge port 204 may be provided to be disposed in opposite directions. The air passing through the evaporator 50 is discharged through the first discharge port 104, and the air passing through the condenser 30 is discharged through the second discharge port 204. As such, the first and second discharge ports 104 and 204 are disposed in the opposite directions such that flows of the discharged air will not be mixed in a discharge process.

A compressor 20, a heat exchanger, and an expansion unit 40 may be disposed in the housing 10. The heat exchanger may include the condenser 30 and the evaporator 50.

The compressor 20 compresses and discharges the refrigerant in a high-temperature high-pressure state, and the compressed refrigerant is introduced into the condenser 30. In the condenser 30, the refrigerant compressed by the compressor 20 is condensed to a liquid phase. Heat is given off to the surroundings in the condensation process.

The expansion unit 40 expands the high-temperature high-pressure liquid refrigerant condensed by the condenser 30 to a low-pressure liquid refrigerant. The evaporator 50 functions to return a low-temperature low-pressure refrigerant gas to the compressor 20 while evaporating the refrigerant expanded by the expansion unit 40, thereby producing a refrigeration effect by heat exchange with a cooling target using the latent heat of evaporation of the refrigerant. A temperature of the air in the indoor space can be controlled through repetition of this cycle.

The expansion unit 40 has various types. However, in an embodiment of the present disclosure, the expansion unit 40 may be formed of a capillary tube. Further, the expansion unit 40 may be provided to pass through the partition 60 provided between the first space 100 and the second space 200.

A first case 110 may be provided in the first space 100.

The first case 110 is configured in such a manner that a first inflow opening 112 is formed at one side thereof so as to be covered by the evaporator 50 and a first outflow opening 114 is formed at the other side thereof. The first ventilation fan 122 (to be described below) is disposed in the first case 110. The first case 110 includes a first ventilation guide 120 so as to form a channel of the first ventilation fan 122.

The first inflow opening 112 is provided to be covered by the evaporator 50, and is disposed such that all the air introduced into the first ventilation fan 122 passes through the evaporator 50. With this configuration, heat exchange efficiency of the evaporator 50 can be improved. The air introduced from the first suction port 102 is introduced to the first ventilation fan 122 via the evaporator 50 and the first inflow opening 112, and is discharged from the first ventilation fan 122 to the outside via the first outflow opening 114 and the first discharge port 104. A channel along which the air flows from the first suction port 102 to the first discharge port 104 can be defined as an evaporation channel PE.

A second case 210 may be provided in the second space 200.

The second case 210 is configured in such a manner that a second inflow opening 212 is formed at one side thereof so as to be covered by the condenser 30 and a second outflow opening 214 is formed at the other side thereof. The second ventilation fan 222 (to be described below) is disposed in the second case 210. The second case 210 includes a second ventilation guide 220 so as to form a channel of the second ventilation fan 222.

The second inflow opening 212 is provided to be covered by the condenser 30, and is disposed such that most of the air introduced into the second ventilation fan 222 passes through the condenser 30. With this configuration, heat exchange efficiency of the condenser 30 can be improved. A control unit 70 of the air conditioner 1 may be disposed in the second case 210. The control unit 70 is provided to be covered by a control unit cover 71, and may be provided with an air inflow hole 76 so as to form a second condensation channel PC2 to be described below.

A ventilation fan may include the first ventilation fan 122 provided for the first space 100, and the second ventilation fan 222 provided for the second space 200. The first ventilation fan 122 is disposed between the first suction port 102 and the first discharge port 104, and guides the air introduced from the first suction port 102 so as to be able to pass through the evaporator 50 to be discharged to the first discharge port 104. The second ventilation fan 222 is disposed between the second suction port 202 and the second discharge port 204, and guides the air introduced from the second suction port 202 so as to be able to pass through the condenser 30 to be discharged to the second discharge port 204.

The first ventilation fan 122 and the second ventilation fan 222 are respectively disposed inside the first ventilation guide 120 and the second ventilation guide 220. The flows of the air discharged from the ventilation fans 122 and 222 are guided by the ventilation guides 120 and 220. Thus, the ventilation guides 120 and 220 guide the flows of the discharged air so as to be able to be discharged to the first discharge port 104 and the second discharge port 204.

The first ventilation fan 122 and the second ventilation fan 222 may be driven by a first driver 124 and a second driver 224, respectively. With this configuration, the first ventilation fan 122 and the second ventilation fan 222 can be independently driven. The driving may vary depending on an operating environment of the air conditioner 1 or a set temperature of the air conditioner 1. The first driver 124 or the second driver 224 is operated by an electric signal received from the control unit 70. For example, the first driver 124 or the second driver 224 may include a motor.

A type of the first ventilation fan 122 or the second ventilation fan 222 is not limited. In an embodiment, a centrifugal fan may be applied by way of example. However, the ventilation fans 122 and 222 are not limited to such a centrifugal fan.

Figure 3:
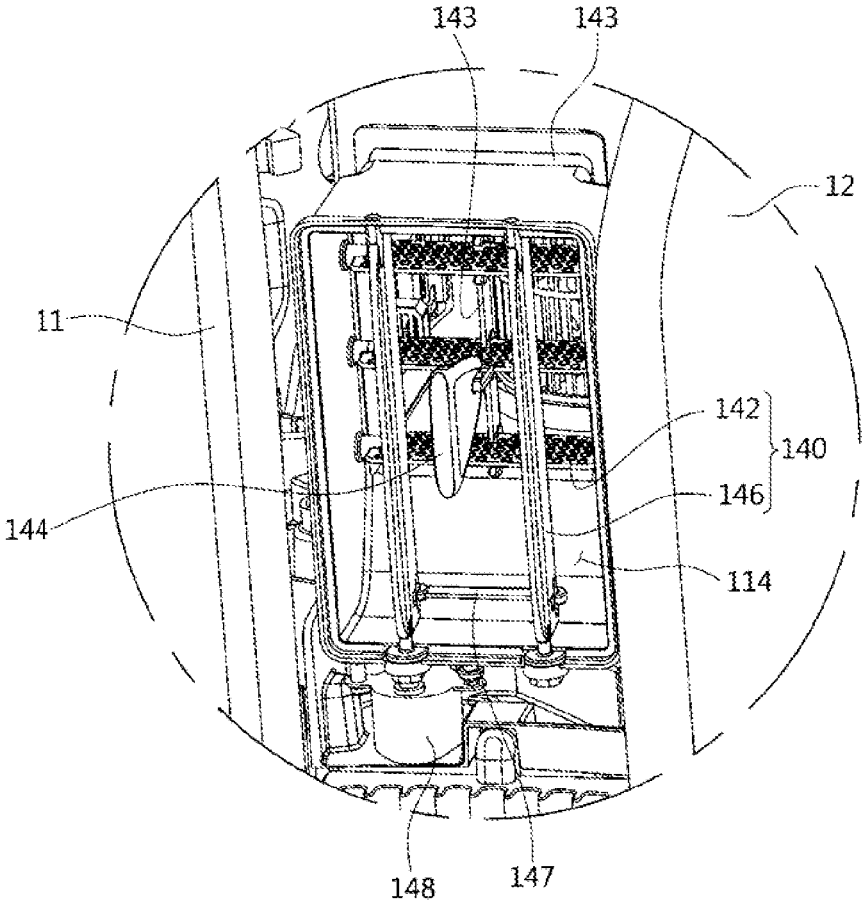
FIG. 3 is a perspective view illustrating blades according to an embodiment of the present disclosure.

FIG. 3 is a perspective view illustrating blades according to an embodiment of the present disclosure.

In FIG. 3, the first outflow opening 114 of the first case 110 is illustrated with no guide 15 mounted on the air conditioner 1.

The first ventilation guide 120 may be provided with blades 140 for guiding the air that is discharged through the first ventilation fan 122 past the first outflow opening 114 to the outside of the housing 10.

The blades 140 may include horizontal blades 142 for guiding an upward/downward direction of the discharged air, and vertical blades 146 for guiding a leftward/rightward direction of the discharged air. The blades 140 may be provided inside the guide 15 so as not to be directly exposed to the outside.

The blades 140 may be electrically controlled by at least one motor, or may be controlled by a separate control handle 144. In an embodiment of the present disclosure, a plurality of horizontal blades 142 may be provided to be coupled to a horizontal pivoting connector 143 so as to be directed in the same direction and to be inclined upward/downward by the control handle 144 provided for any one of the plurality of horizontal blades 142. The control handle 144 is provided to be exposed to the outside across the guide 15 so as to be able to vertically control the control handle 144 from the outside.

Further, a plurality of vertical blades 146 may be provided to be coupled to a vertical pivoting connector 147 so as to be directed in the same direction and to be inclined leftward/rightward by a blade driver 148 provided for any one of the plurality of vertical blades 146. With this configuration, a direction in which the air is discharged through the first discharge port 104 can be controlled.

Figure 4:
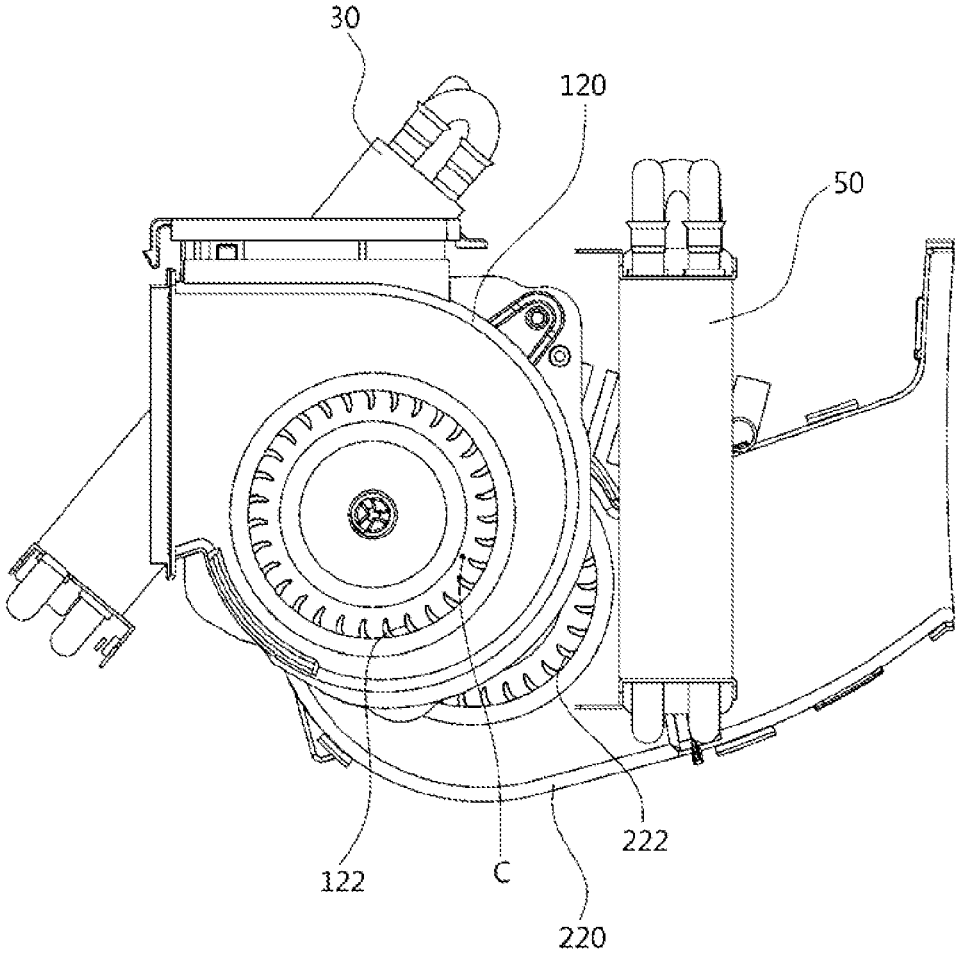
FIG. 4 is a plan view of some components of the air conditioner according to an embodiment of the present disclosure.
Figure 5:
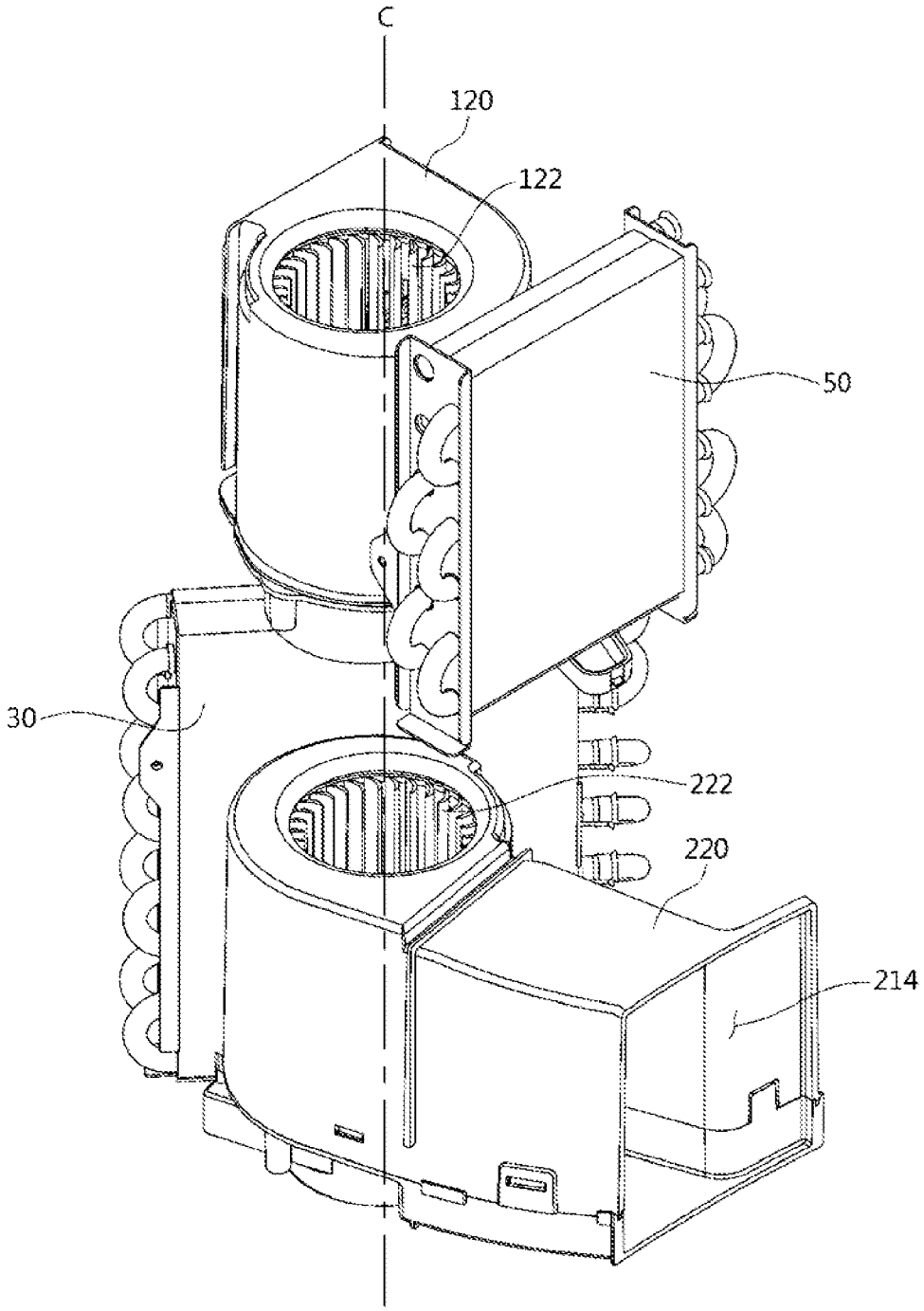
FIG. 5 is a perspective view of some components of the air conditioner according to an embodiment of the present disclosure.

FIG. 4 is a plan view of some components of the air conditioner according to an embodiment of the present disclosure, and FIG. 5 is a perspective view of some components of the air conditioner according to an embodiment of the present disclosure.

Each of the heat exchangers 30 and 50 and the ventilation fans 122 and 222 may be disposed such that the center of gravity thereof is located in the middle of the air conditioner 1. In detail, assuming that a vertical extension line from the middle of the handle 18 in a downward direction or in a direction directed to the base is a center line C, each of the heat exchangers 30 and 50 and the ventilation fans 122 and 222 may be provided such that the center of gravity thereof passes through the center line C.

To be specific, the evaporator 50 and the condenser 30 are disposed across the partition 60 on upper and lower sides so as to be spaced apart from each other at a given angle, and may be disposed such that the centers of gravity thereof pass the center line C. Further, the first ventilation fan 122 and the second ventilation fan 222 are disposed across the partition 60 on upper and lower sides. The first ventilation fan 122 and the second ventilation fan 222 may be disposed such that the centers of gravity thereof pass through the center line C.

The condenser 30 receives ambient heat from the gaseous refrigerant passing through the compressor 20, and absorbs both sensible heat and latent heat of the refrigerant itself to condense the refrigerant. The evaporator 50 absorbs only the latent heat of evaporation from the same flow rate of refrigerant in theory, and evaporates the refrigerant to absorb ambient heat. As such, the condenser 30 may be disposed to have a wider area than the evaporator 50.

In the present embodiment, the condenser 30 is disposed to have a wider area than the evaporator 50, and the heat exchangers are disposed such that the center of gravity therebetween is adjacent to the center line C. To make the air conditioner 1 smaller, the condenser 30 is disposed to be inclined with respect to the evaporator 50 at a given angle. That is, the condenser 30 and the evaporator 50 are disposed to be spaced apart from each other at a given angle. Thereby, it is possible to increase spatial efficiency of the internal space of the air conditioner 1.

Figure 6:
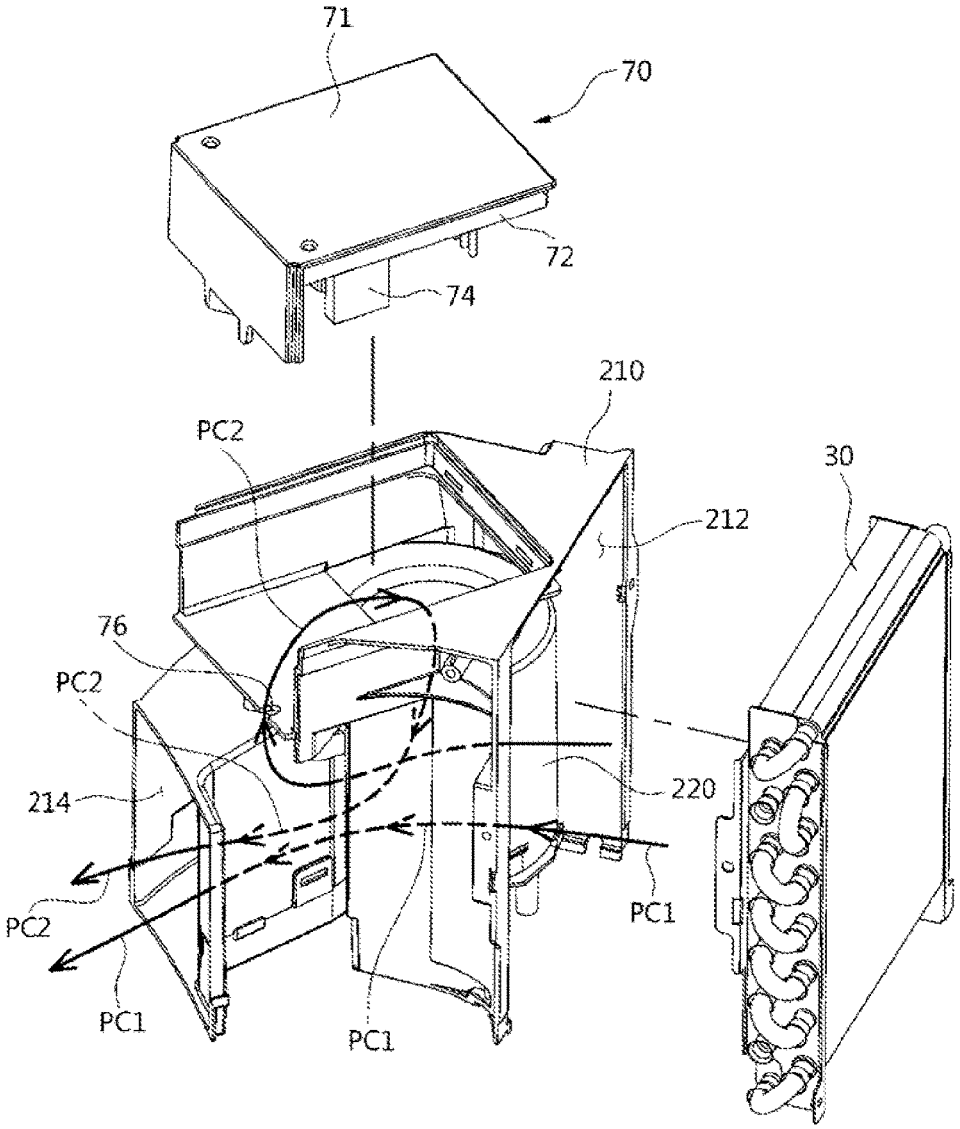
FIG. 6 is an exploded perspective view of some components of a second space in the air conditioner according to an embodiment of the present disclosure.

FIG. 6 is an exploded perspective view of some components of the second space in the air conditioner according to an embodiment of the present disclosure.

The second case 210, the condenser 30, the compressor 20, the second ventilation fan 222, and the second ventilation guide 220 may be disposed in the second space 200.

The control unit 70 for the operation of the air conditioner 1 may be provided on one side of the second case 210. In the present embodiment, the control unit 70 may be disposed at an upper portion of the second case 210.

The second space 200 may include a first condensation channel PC1 along which the air passes through the second suction port 202, the condenser 30, and the second ventilation fan 222 and is discharged to the second outflow opening 214 and the second discharge port 204, and a second condensation channel PC2 along which the air passes through the second suction port 202, the control unit 70, and the second ventilation fan 222 and is discharged to the second outflow opening 214 and the second discharge port 204.

The air introduced from the second suction port 202 is distributed to flow to the first condensation channel PC1 and the second condensation channel PC2, and exchanges heat with the condenser 30 while passing along the first condensation channel PC1 and to cause heat to be released from the control unit 70 while passing along the second condensation channel PC2.

In detail, one side of the control unit 70 is formed with the air inflow hole 76 such that part of the air introduced into the second suction port 202 can be introduced, and the other side of the control unit 70 is provided to communicate with the internal space of the second case 210 having the second ventilation fan 222 and the second ventilation guide 220.

If a flow rate of the air passing along the second condensation channel PC2 is more than that of the air passing along the first condensation channel PC1, the heat exchange efficiency of the condenser 30 is reduced, and thus the air inflow hole 76 formed on the second condensation channel PC2 may be formed smaller than a width of the condenser 30.

In detail, the air inflow hole 76 may be formed at such a size as to dissipate heat of a circuit board 72 of the control unit 70 and heat of a heat sink 74 mounted on the circuit board 72.

Figure 7:
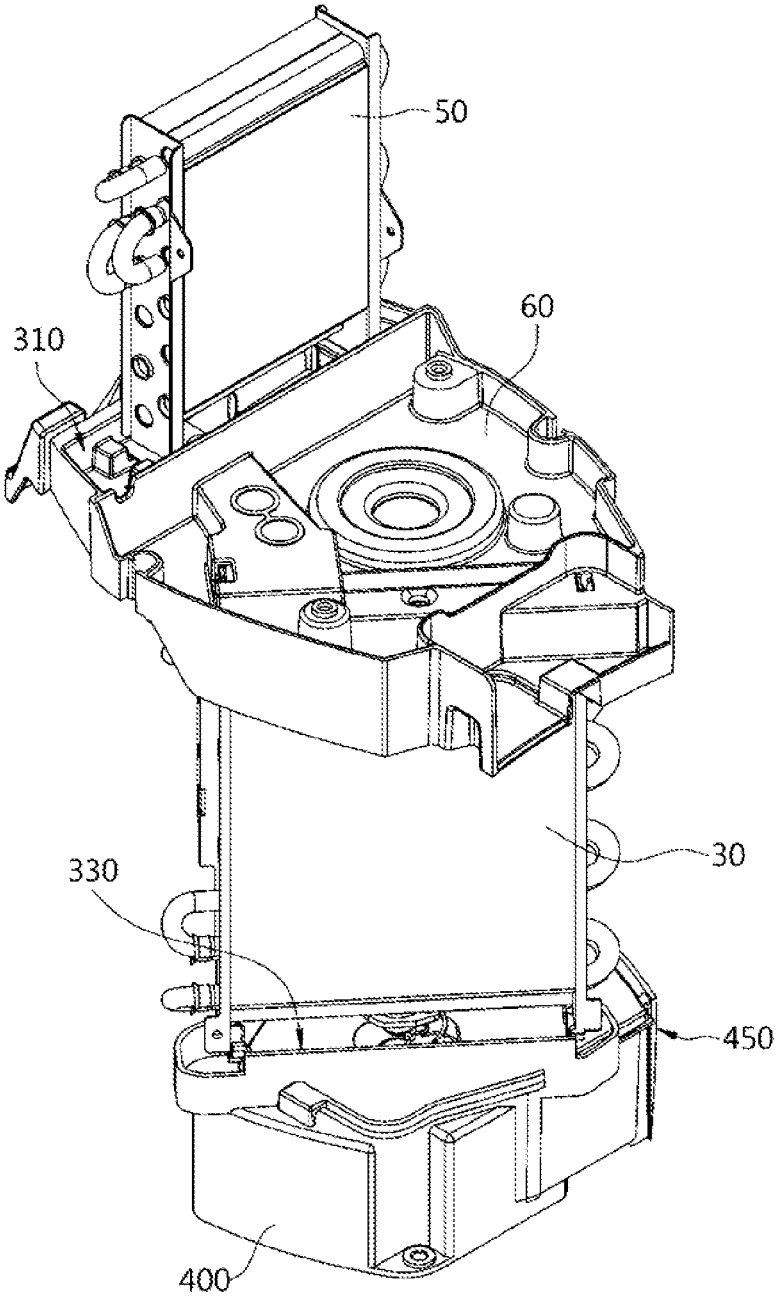
FIG. 7 is a perspective view of some components of the air conditioner according to an embodiment of the present disclosure.
Figure 8:
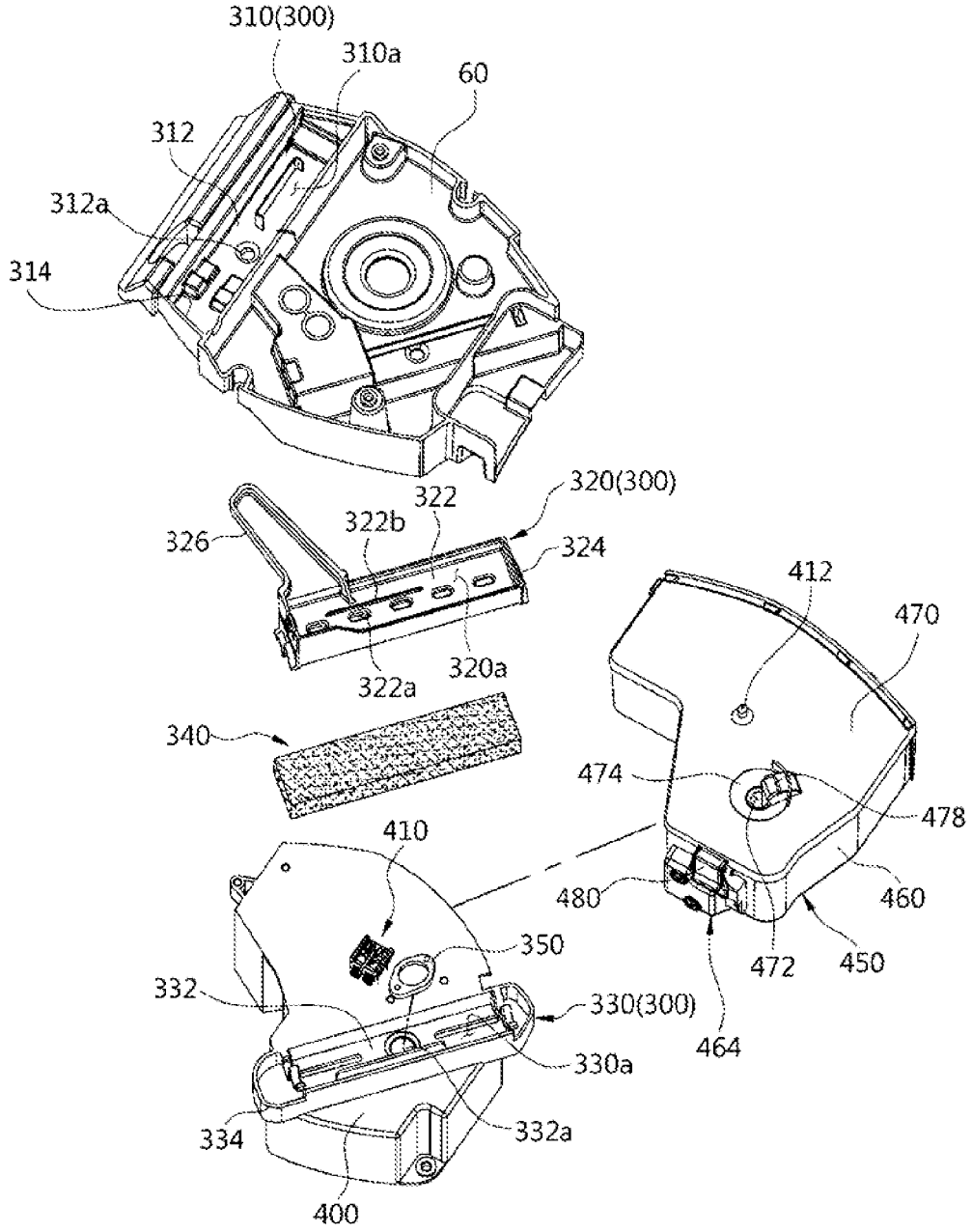
FIG. 8 is an exploded perspective view of a tray assembly, an insertion case, and a water tank in the air conditioner according to an embodiment of the present disclosure.
Figure 9:
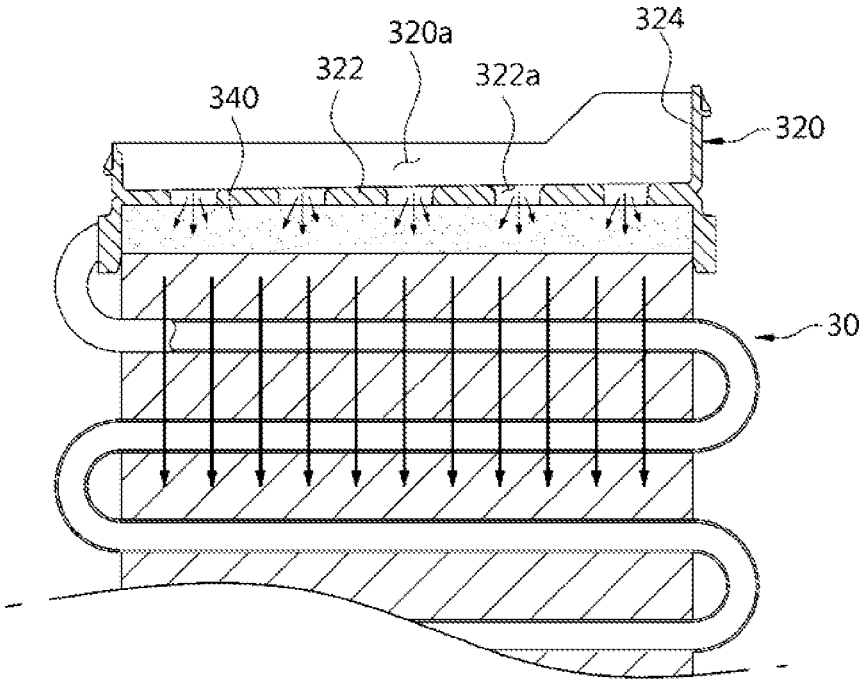
FIG. 9 is a view of a flow of a condensate at an auxiliary member of the air conditioner according to an embodiment of the present disclosure.

FIG. 7 is a perspective view of some components of the air conditioner according to an embodiment of the present disclosure. FIG. 8 is an exploded perspective view of a tray assembly, an insertion case, and a water tank in the air conditioner according to an embodiment of the present disclosure. FIG. 9 is a view of a flow of a condensate at an auxiliary member of the air conditioner according to an embodiment of the present disclosure.

The air conditioner 1 is provided to be able to operate in a cooling mode and in a dehumidifying mode. In the cooling mode, the refrigerant circulates through the compressor 20, the condenser 30, the expansion unit 40, and the evaporator 50, and cooled air is discharged out of the air conditioner 1 by heat exchange between the evaporator 50 and the external or indoor air. In the dehumidifying mode, a condensate generated on a surface of the evaporator 50 due to a flow of the refrigerant and inflow and outflow of the external air in the cooling mode is removed, thereby removing moisture in the air.

The tray assembly 300 is provided to operate the cooling mode and the dehumidifying mode.

In detail, in the cooling mode, the condensate generated from the evaporator 50 is discharged to the condenser 30 so as to improve the heat exchange efficiency of the condenser 30. Further, in the dehumidifying mode, the condensate generated from the evaporator 50 is discharged to the water tank 450 in which the condensate is stored so as to remove the moisture in the air.

The water tank 450 is provided to collect the condensate generated from the evaporator 50. The water tank 450 is not limited to this disposition or shape. In an embodiment of the present disclosure, the water tank 450 is formed in the shape of a cassette, and is provided to be separable from the housing 10 at the lower portion of the housing 10.

The tray assembly 300 may include a first tray 310 and a second tray 320.

The first tray 310 is provided with a water storage space 310*a* in which the condensate generated from the evaporator 50 is stored. The second tray 320 is provided to receive the condensate from the first tray 310 and discharge it to the condenser 30.

The first tray 310 is formed below the evaporator 50 such that one side thereof directed to the evaporator 50 has the shape of an open water conduit. Thereby, the condensate generated by the heat exchange between the evaporator 50 and the air introduced from the outside can be collected on the first tray 310.

The first tray 310 may be disposed, as an independent component, below the evaporator 50. In the present embodiment, the first tray 310 is formed to extend from the partition 60, to collect the condensate generated from the evaporator 50 and simultaneously to partition the housing into the first space 100 and the second space 200 as a part of the partition 60.

The first tray 310 may include a first tray bottom 312 formed to face a lower portion of the evaporator 50, and a first tray flange 314 formed to extend upward from an end of the first tray bottom 312.

The first tray bottom 312 is provided with a drain hole 312*a* so as to be able to supply the condensate to the second tray 320. The first tray bottom 312 may be formed to be inclined toward the drain hole 312*a* such that the condensate, which falls from the evaporator 50 and is collected on the first tray 310, can be smoothly discharged through the drain hole 312*a*. The first tray bottom 312 is formed to be equal to or greater than a width of the lower portion of the evaporator 50, and can prevent the condensate generated from the evaporator 50 from falling outside the first tray 310 and contaminating the internal space of the air conditioner 1.

The second tray 320 is provided to receive the condensate from the first tray 310 and to discharge it to the condenser 30.

The second tray 320 is disposed above the condenser 30, and may be formed to extend in a lengthwise direction of the condenser 30. The second tray 320 is provided with a supply space 320*a* in which the condensate delivered from the first tray 310 is stored so as to be able to supply the condensate to the condenser 30 on the whole.

The second tray 320 may include a second tray bottom 322 formed to correspond to an upper portion of the condenser 30, and a second tray flange 324 formed to extend upward from an end of the second tray bottom 322.

The second tray bottom 322 is provided with at least one supply hole 322*a*. The supply holes 322*a* are disposed apart from each other so as to correspond to an upper shape of the condenser 30. The condensate generated from the evaporator 50 is supplied to the condenser 30 via the supply hole 322*a*, and wets a surface of the condenser 30. Thereby, it is possible to improve the heat exchange efficiency of the condenser 30.

The second tray bottom 322 is formed to be parallel with the lower portion of the condenser 30. Further, the second tray bottom 322 may be provided to be inclined in a direction directed to the end of the second tray bottom 322 such that the condensate generated from the evaporator 50 can be smoothly discharged through the supply hole 322*a*. The at least one supply hole 322*a* may be disposed in a lengthwise direction of the second tray bottom 322.

In detail, the multiple supply holes 322*a* are disposed at intervals in the lengthwise direction of the second tray bottom 322. The second tray bottom 322 may be provided such that the condensate discharged from the first tray 310 through the drain hole 312*a* is uniformly supplied to the multiple supply holes 322*a* and such that the supply hole 322*a* disposed downstream on a traveling path of the condensate flowing into the second tray bottom 322 is located at a lower position than the supply hole 322*a* disposed upstream.

The second tray bottom 322 is formed to correspond to a width of the upper portion of the condenser 30, and can prevent the condensate generated from the evaporator 50 from falling beyond the condenser 30 to contaminate the internal space of the air conditioner 1.

The second tray 320 may include a supply guide 326 for guiding the condensate from the drain hole 312*a* of the first tray 310 to the supply space 320*a* of the second tray 320. The supply guide 326 is formed to extend from the second tray 320, and may be integrally formed with the second tray 320. An end of the supply guide 326 is formed to pass below the drain hole 312*a* of the first tray 310, and forms a movement channel such that the condensate discharged to the drain hole 312*a* is guided to the supply space 320*a* of the second tray 320.

The second tray 320 may include a spread rib 322*b* that is provided on the second tray bottom 322 and is disposed upstream relative to the supply hole 322*a* on the movement path of the condensate. The spread rib 322*b* may be disposed upstream relative to the supply holes 322*a* on the movement path of the condensate to prevent the condensate moving along the supply guide 326 from being concentrated on and introduced into a supply hole 324*a* adjacent to the supply guide 326 among the multiple supply holes 322*a*. The condensate is dispersed in the lengthwise direction of the second tray 320 by the spread rib 322*b*. Thereby, it is possible to more uniformly introduce the condensate into the multiple supply holes 322*a* so that no single hole acts as a bottleneck that reduces the flow of condensate.

An auxiliary member 340 may be provided between the second tray 320 and the condenser 30 such that the condensate discharged from the second tray 320 is uniformly supplied to the condenser 30.

The auxiliary member 340 is provided such that the condensate discharged from at least one of the supply holes 322*a* of the second tray 320 can be uniformly dispersed and discharged to the upper portion of the condenser 30. The auxiliary member 340 may have a porous structure, for instance a sponge structure.

The auxiliary member 340 is provided to cover the upper portion of the condenser 30, and may be provided between the condenser 30 and the second tray 320 under pressure so as to be able to smoothly discharge the condensate to the condenser 30.

The tray assembly 300 may further include a third tray 330. The third tray 330 may be provided below the condenser 30 such that the condensate passing through the condenser 30 is collected. The third tray 330 is disposed below the condenser 30, is formed to extend in the lengthwise direction of the condenser 30, and is provided with a discharge space 330*a* such that the condensate passing through the condenser 30 may be collected.

The third tray 330 may include a third tray bottom 332 formed to correspond to a lower portion of the condenser 30, and a third tray flange 334 formed to extend upward from an end of the third tray bottom 332.

The third tray bottom 332 is provided with a discharge hole 332*a* so as to be able to discharge the condensate to the water tank 450. The third tray bottom 332 may be formed to be inclined toward the discharge hole 332*a* such that the condensate, which falls from the condenser 30 and is collected on the third tray 330, can be smoothly discharged through the discharge hole 332*a*. The third tray bottom 332 is formed to be equal to or greater than a width of the lower portion of the condenser 30, and can prevent the condensate generated from the condenser 30 from falling outside the third tray 330 to contaminate the internal space of the air conditioner 1.

The discharge hole 332*a* may be opened/closed by an opening/closing cap 350. The opening/closing cap 350 is provided to move to a closing position 350*a* for closing the discharge hole 332*a* and an opening position 350*b* for opening the discharge hole 332*a*. The movement from the closing position 350*a* to the opening position 350*b* is performed by an opening protrusion 478 of the water tank 450 to be described below, and the movement from the opening position 350*b* to the closing position 350*a* may be performed by a dead load.

The third tray 330 may be disposed as an independent component. In an embodiment, the third tray 330 may be integrally formed with an insertion case 400 in which the water tank 450 (to be described below) is placed.

Hereinafter, operations of the air conditioner 1 according to the cooling mode and the dehumidifying mode will be described.

In the cooling mode, the condensate generated from the surface of the evaporator 50 is stored in the first tray 310, and the condensate stored in the first tray 310 wets the surface of the condenser 30 through the supply hole 322*a* of the second tray 320. Thereby, it is possible to improve the heat exchange efficiency of the condenser 30.

In this case, the moisture in the air is converted into the condensate, and the condensate is evaporated on the surface of the condenser 30 again. As such, humidity of the external air can be nearly constantly maintained.

In the dehumidifying mode, the condensate generated from the surface of the evaporator 50 is stored in the first tray 310, and the condensate stored in the first tray 310 is discharged to the water tank 450 by a bypass pipe (not shown) connecting the first tray 310 and the water tank 450.

In this case, the moisture in the air is converted into the condensate, and the condensate is discharged to the water tank 450. As such, the humidity of the external air is gradually reduced. That is, the moisture is removed in this process.

Hereinafter, the water tank of the air conditioner according to an embodiment of the present disclosure will be described.

Figure 10:
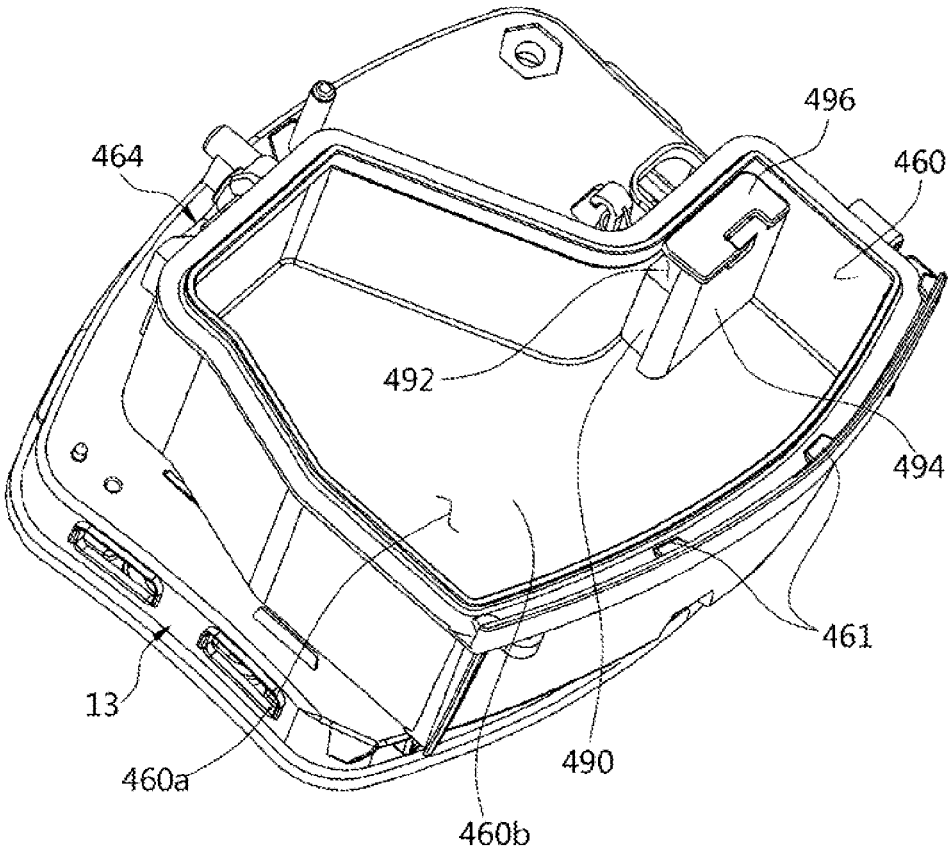
FIG. 10 is a perspective view of an interior of the water tank in the air conditioner according to an embodiment of the present disclosure.
Figure 11:
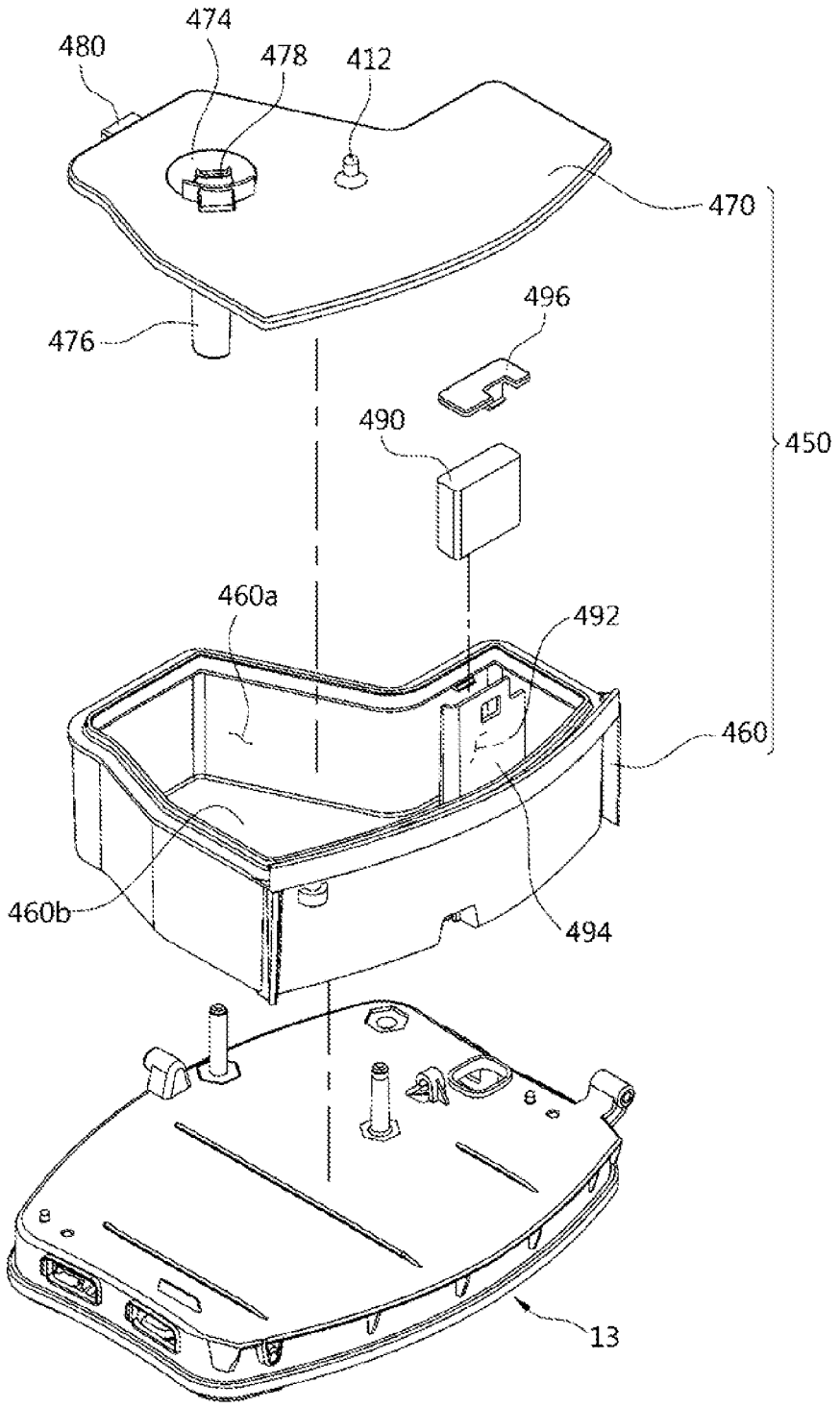
FIG. 11 is an exploded perspective view of the water tank and a base in the air conditioner according to an embodiment of the present disclosure.

FIG. 10 is a perspective view of an interior of the water tank in the air conditioner according to an embodiment of the present disclosure, and FIG. 11 is an exploded perspective view of the water tank and the base in the air conditioner according to an embodiment of the present disclosure.

The water tank 450 may be provided at the lower portion of the housing 10 such that the condensate generated according to the cooling mode or the dehumidifying mode of the air conditioner 1 can be stored.

The water tank 450 is removably provided in the air conditioner 1, and is provide to be able to be put into or taken out of the insertion case 400 disposed at the lower portion of the housing 10. To this end, an interior of the insertion case 400 is provided with a seating space 400*a* corresponding to a shape of the water tank 450 such that the water tank 450 can be placed.

The water tank 450 includes a storage case 460 having a storage space 460*a* in which the condensate is contained, and a case cover 470 provided at one side of the storage case 460. The storage case 460 may be provided with an open upper surface, and the case cover 470 may be provided to open/close the open upper surface of the storage case 460.

The case cover 470 may be provided with an inflow hole 472 so as to correspond to the discharge hole 332*a* of the third tray 330. The inflow hole 472 is provided below the discharge hole 332*a* such that the condensate discharged through the discharge hole 332*a* is introduced into the water tank 450. A width of the inflow hole 472 may be provided to correspond to that of the discharge hole 332*a*.

The case cover 470 may be provided with an inflow inclined plane 474 that is formed along a circumference of the inflow hole 472 and is formed to be inclined from the upper surface of the neighboring case cover 470 toward the inflow hole 472. The inflow inclined plane 474 is formed along the circumference of the inflow hole 472, and guides the condensate discharged from the discharge hole 332*a* such that the discharged condensate can be stably introduced into the inflow hole 472.

The case cover 470 is provided with a guide tube 476 on an inner surface thereof which guides the condensate introduced through the inflow hole 472. The guide tube 476 is formed in a rod shape, and has a guide hole 476*a* in an interior thereof communicating with the inflow hole 472. The condensate introduced through the inflow hole 472 may be guided through the guide hole 476*a* of the guide tube 476 and may be introduced into the water tank 450.

The guide tube 476 may be integrally formed with the case cover 470 on an inner side of the case cover 470. An end of the guide tube 476 is spaced apart from the bottom of the storage case 460 such that the condensate discharged through the guide tube 476 can be stored in the storage case 460.

Hereinafter, an operation of the opening/closing cap base on the insertion of the water tank according to an embodiment of the present disclosure will be described.

Figure 12A:
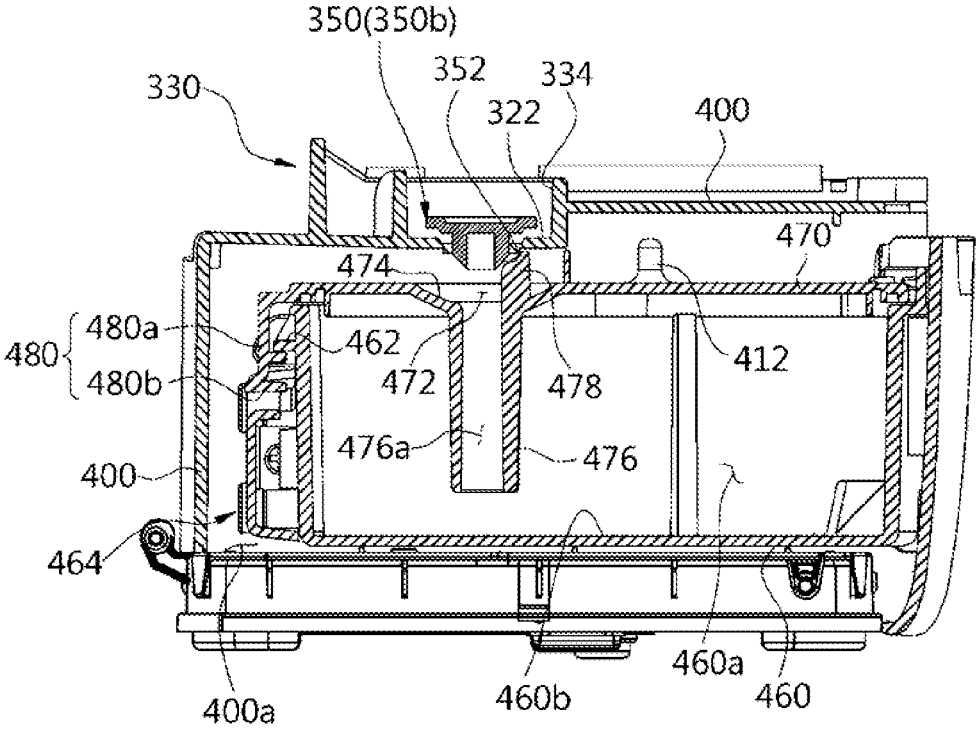
FIGS. 12A and 12B are views of separating and inserting operations of the water tank in the air conditioner according to an embodiment of the present disclosure.
Figure 12B:
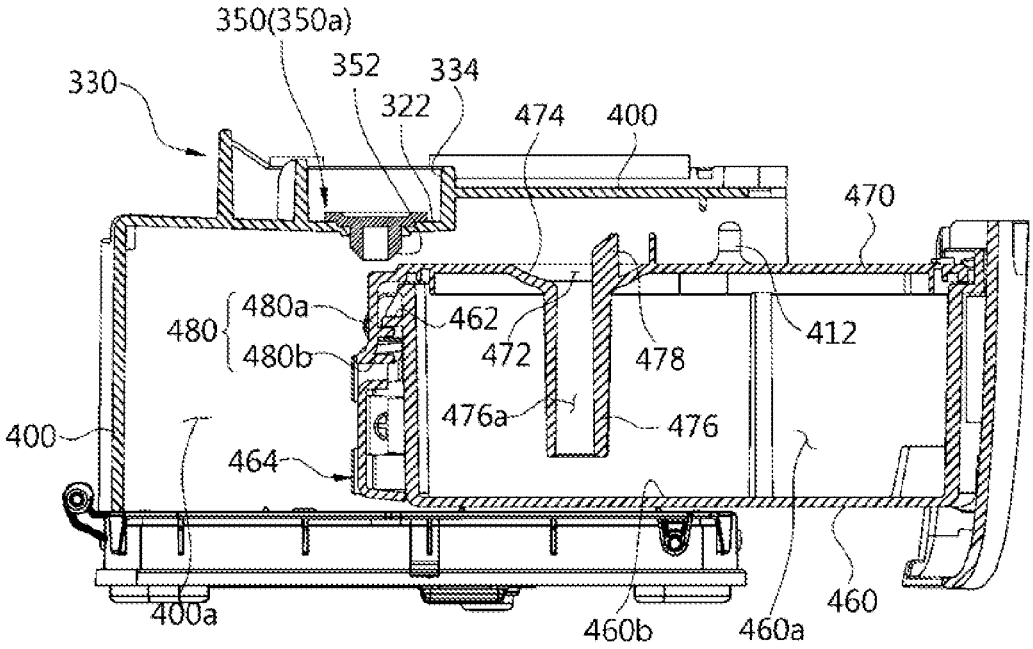

FIGS. 12A and 12B are views of separating and inserting operations of the water tank in the air conditioner according to an embodiment of the present disclosure.

The case cover 470 may be provided with an opening protrusion 478 disposed adjacent to the inflow hole 472 on an outside thereof. The opening protrusion 478 is provided to push out the opening/closing cap 350 of the discharge hole 332*a* so as to be able to move from the closing position 350*a* to the opening position 350*b*. The opening/closing cap 350 is operated by the opening protrusion 478. Thereby, the discharge hole 332*a* is opened when the water tank 450 is inserted into the air conditioner 1, and the discharge hole 332*a* is closed when the water tank 450 is separated from the air conditioner 1.

As in FIG. 12A, when the water tank 450 is inserted, the opening protrusion 478 pushes up the opening/closing cap 350, and the opening/closing cap 350 moves from the closing position 350*a* to the opening position 350*b*. The opening/closing cap 350 has a cap pressing face 352 formed in an inclined manner such that the opening/closing cap 350 can move in a direction perpendicular to a direction in which the water tank 450 is inserted. The opening protrusion 478 presses the cap pressing face 352 while the water tank 450 is inserted into the seating space 400*a*, and the opening/closing cap 350 moves from the closing position 350*a* to the opening position 350*b* in an upward direction.

As in FIG. 12B, when the water tank 450 is separated, the opening/closing cap 350 moves to the closing position 350*a* due to its dead load, closing the discharge hole 332*a*. When the discharge hole 332*a* is closed, the condensate falling from the condenser 30 to the third tray 330 is not discharged and is collected in the third tray 330.

As the opening/closing cap 350 is operated by the opening protrusion 478 of the water tank 450, it is possible to restrict the discharge of the condensate to prevent the interior of the air conditioner 1 from being contaminated when the water tank 450 is separated from the air conditioner 1, and to guide the discharge of the condensate from the third tray 330 to the water tank 450 when the water tank 450 is inserted into the air conditioner 1.

Hereinafter, separating and inserting processes of the water tank from and into the insertion case according to an embodiment of the present disclosure will be described.

Figure 13A:
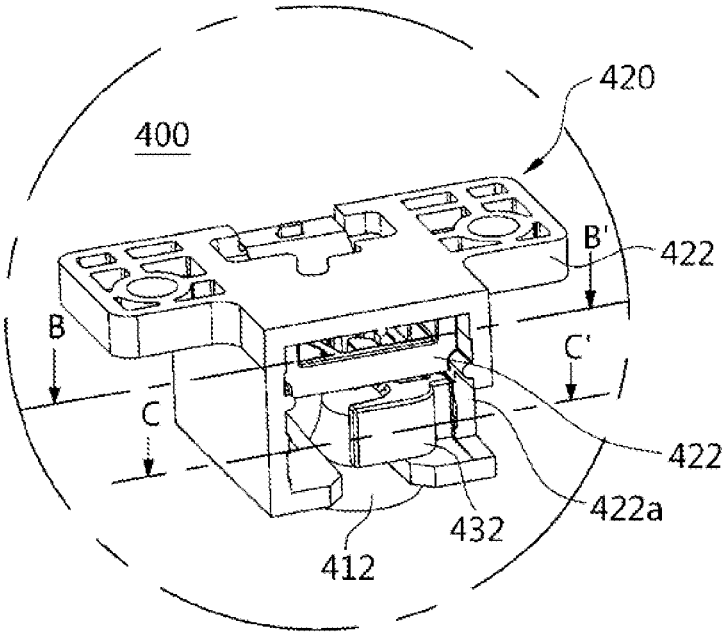
FIG. 13A is a perspective view of a latch unit according to an embodiment of the present disclosure.
Figure 13B:
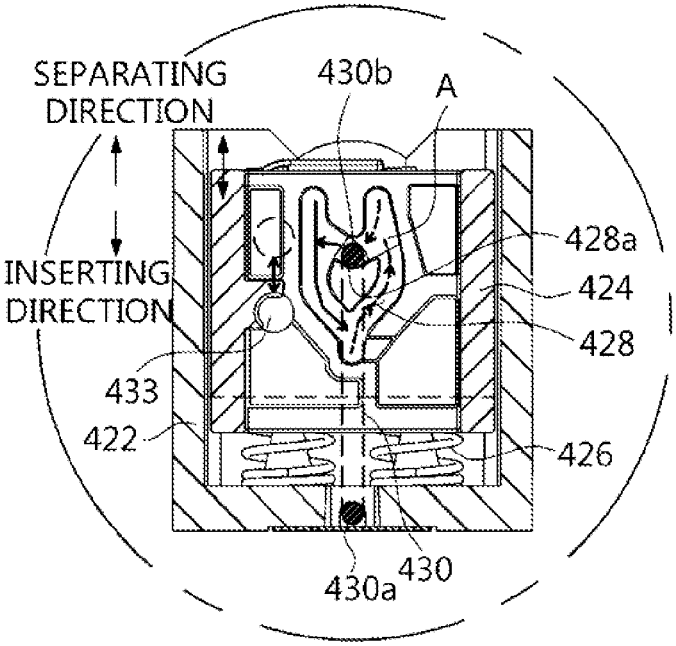
FIG. 13B is a cross-sectional view taken along line B-B' of FIG. 13A.
Figure 13C:
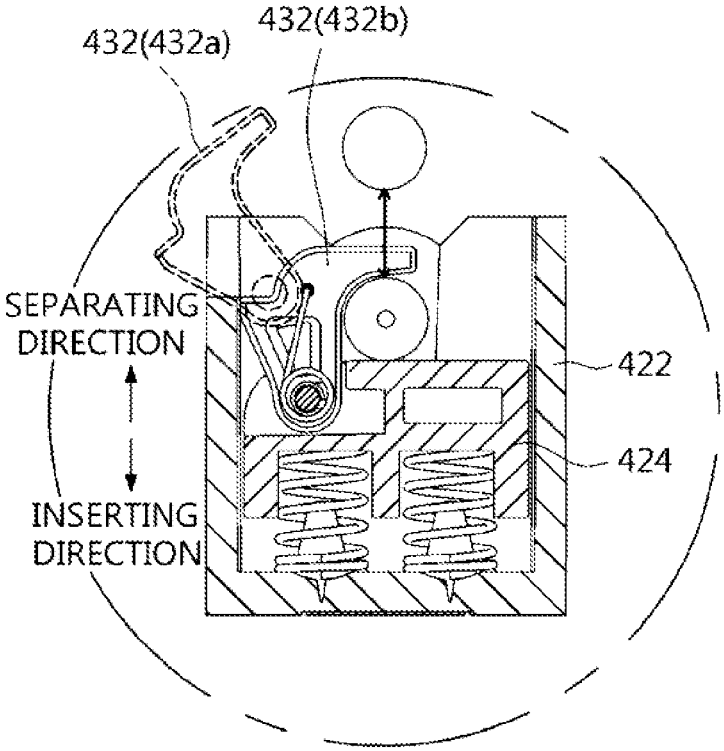
FIG. 13C is a cross-sectional view taken along line C-C' of FIG. 13A.

FIG. 13A is a perspective view of a latch unit according to an embodiment of the present disclosure. FIG. 13B is a cross-sectional view taken along line B-B' of FIG. 13A, and FIG. 13C is a cross-sectional view taken along line C-C' of FIG. 13A.

The insertion case 400 in which the water tank 450 is placed may be provided with a latch unit 410.

The latch unit 410 is provided to be able to lock or unlock the water tank 450 when the water tank 450 is inserted into or separated from the insertion case 400.

The water tank 450 is provided to be separable from the insertion case 400 in a push-and-push operation. Here, in a state in which the water tank 450 is locked by the latch unit 410, when the water tank 450 is pushed, the water tank 450 is unlocked. In a state in which the water tank 450 is unlocked, when the water tank 450 is pushed, the water tank 450 is locked.

The latch unit 410 includes a latching protrusion 412 formed to protrude from the upper surface of the case cover 470 of the water tank 450, and a latch 420 provided to catch or release the latching protrusion 412.

The latch 420 is provided inside the insertion case 400 such that the water tank 450 is fixed to the insertion case 400. The latching protrusion 412 is provided on the upper surface of the case cover 470 in a protruding shape. The latching protrusion 412 can be inserted into the latch 420B.

The latch 420 may include a latch housing 422 fixed inside a fixing part, a slide member 424 reciprocating in the latch housing 422, a spring 426 resiliently supporting the slide member 424, a guide slot 428 provided for the slide member 424, a guide bar 430 whose fixing end 430*a* is hinged to the latch housing 422 and whose movable end 430*b* is inserted into the guide slot 428 and guides or restricts the reciprocation of the slide member 424, and a catch member 432 that is provided at an end of the slide member 424 and catches or releases the latching protrusion 412. The catch member 432 is provided to be rotatable about its rotational shaft, and is rotated by advancing/retreating movement of the slide member 424. The catch member 432 moves to a reception position 432*a* at which it is rotated to be able to receive the latching protrusion 412, and a restraint position 432*b* at which it is rotated from the reception position 432*a* to catch the latching protrusion 412.

The catch member 432 may be rotated from the reception position 432*a* to the restraint position 432*b* by a pressing face of the latch housing 422, and from the restraint position 432*b* to the reception position 432*a* by a return spring 434.

When the water tank 450 is pushed into the insertion case 400, the latching protrusion 412 moves in a direction in which the water tank 450 is inserted. Then, the latching protrusion 412 pushes the slide member 424 in the inserting direction.

The slide member 424 overcomes an elastic force of a spring 426, and moves in the inserting direction. Here, the movable end 430*b* of the guide bar 430 moves along the guide slot 428 in a direction of a dashed line A.

As a result, the movable end 430*b* of the guide bar 430 is supported by a supporting face 428*a* of the guide slot 428, and thereby the movement of the slide member 424 is stopped. Here, the catch member 432 is rotated to be able to catch the latching protrusion 412, and the water tank 450 is fixed. In detail, the catch member 432 is rotated from the reception position 432*a* to the restraint position 432*b* and restrains the latching protrusion 412 while the rotational shaft 433 thereof moves in the inserting direction along with the slide member 424 and one side thereof is pressed by the pressing face 422*a* of the latch housing 422.

In this state, when the water tank 450 is pressed in the inserting direction again, the movable end 430*b* of the guide bar 430 moves along the guide slot 428 in a direction of a solid line B, and the catch member 432 returns to the original state. Thereby, the latching protrusion 412 caught by the catch member 432 is released, and the water tank 450 is unfixed to move in a separating direction. In detail, the rotational shaft 433 of the catch member 432 moves in the separating direction along with the slide member 424, and the catch member 432 is rotated from the restraint position 432*b* to the reception position 432*a* by the return spring 434, and releases the restraint of the latching protrusion 412.

Meanwhile, a front surface of the water tank 450 may be provided with a push part 452 which a user can easily push.

Hereinafter, separating and coupling of the water tank and the insertion case according to an embodiment of the present disclosure will be described.

Figure 14:
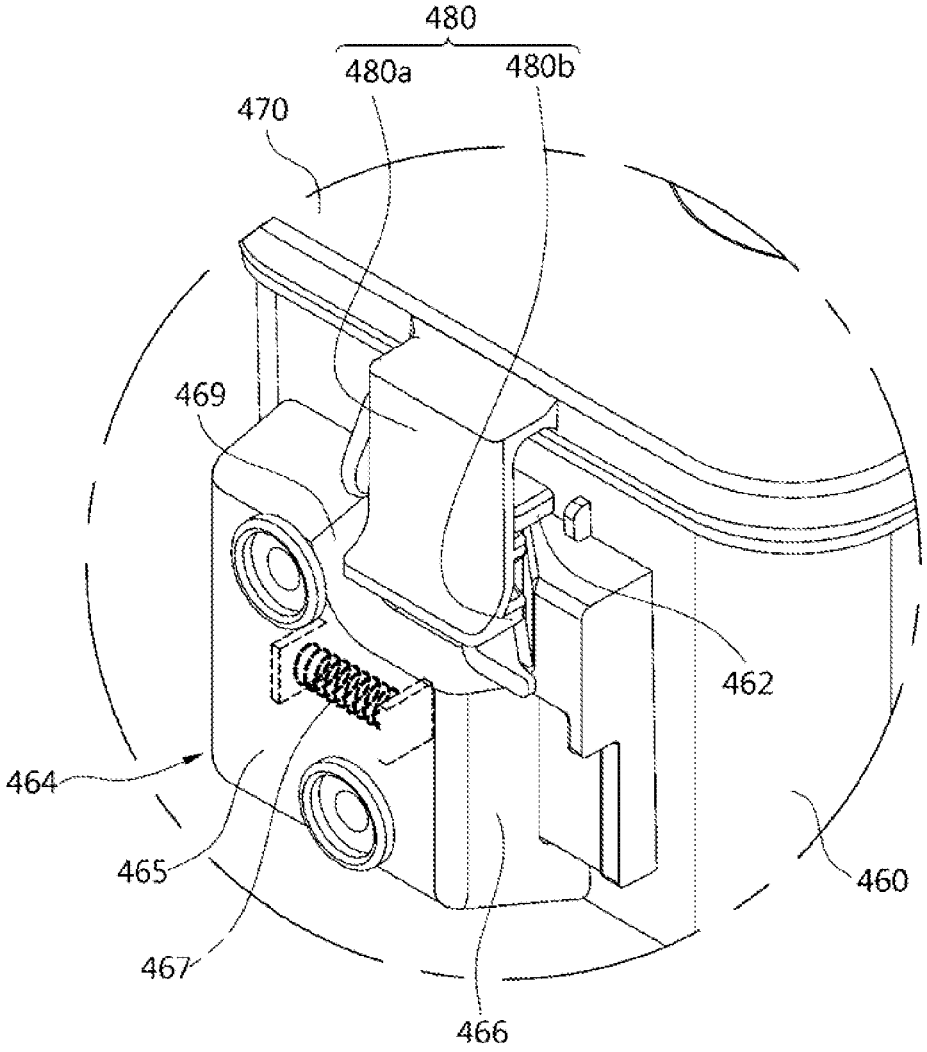
FIG. 14 is a view of coupling of the water tank in the air conditioner according to an embodiment of the present disclosure.

FIG. 14 is a view of coupling of the water tank in the air conditioner according to an embodiment of the present disclosure.

The case cover 470 is provided on the open upper surface of the storage case 460 so as to be removably coupled. One side of the case cover 470 is provided to be fitted into the storage case 460, and the other side of the case cover 470 is provided to be hooked onto the storage case 460 by a hook member 480.

In detail, the storage case 460 is provided with fitting noses 461 on one side thereof which correspond to the one side of the case cover 470 so as to be able to restrain the one side of the case cover 470, and a fixing nose 462 on the other side thereof which corresponds to a hook member 480 of the case cover 470 so as to be able to restrain the other side of the case cover 470.

The case cover 470 may be provided with the hook member 480 at one end thereof so as to be able to be hooked onto the fixing nose 462 of the storage case 460. The hook member 480 releases restraint on the fixing nose 462 by an opening/closing member 464 to be described below. To be specific, when the open side of the storage case 460 is sealed by the case cover 470, the hook member 480 is hooked onto the fixing nose 462 of the storage case 460 and thereby maintains a sealed state. When the one side of the storage case 460 is opened, the opening/closing member 464 is provided to separate the hook member 480 and the fixing nose 462 from each other.

The hook member 480 may include a hook member body 480*a* formed to extend from the case cover 470 along an outer lateral face of the storage case 460, and a snap part 480*b* formed at an end of the hook member body 480*a* so as to protrude toward the storage case 460 to be hooked onto the fixing nose 462. The hook member body 480*a* may be provided with a predetermined curvature so as to closely push the snap part 480*b* toward the storage case 460 without the snap part 480*b* easily separating from the fixing nose 462. Further, the hook member body 480*a* is provided with elasticity so as to be able to separate the hook member 480 and the fixing nose 462 when the opening/closing member 464 is operated.

The opening/closing member 464 may include an opening/closing member body 465, a pushing part 466, an elastic return part 467, and an unhooking part 469.

The opening/closing member body 465 is provided to be slidable along an outer surface of the storage case 460. The pushing part 466 is provided to receive an external force from the outside at the opening/closing member body 465. The elastic return part 467 applies a force reacting against the external force such that the opening/closing member 464 pressed to slide by the pushing part 466 returns to its original position again. The elastic return part 467 may be formed of an elastic material in order to generate a force for returning to the original position. In the present embodiment, a spring is used by way of example. However, any component may be used if it can move the opening/closing member 464 to the original position. The elastic return part 467 may be disposed such that one end thereof is fixed to the storage case 460 and the other end thereof is fixed inside the opening/closing member body 465.

The unhooking part 469 is provided at one side of the opening/closing member body 465, comes into contact with the hook member 480 with the movement of the opening/closing member body 465, and separates the hook member 480 from the fixing nose 462.

Hereinafter, a water level sensor of the water tank according to an embodiment of the present disclosure will be described.

Figure 15:
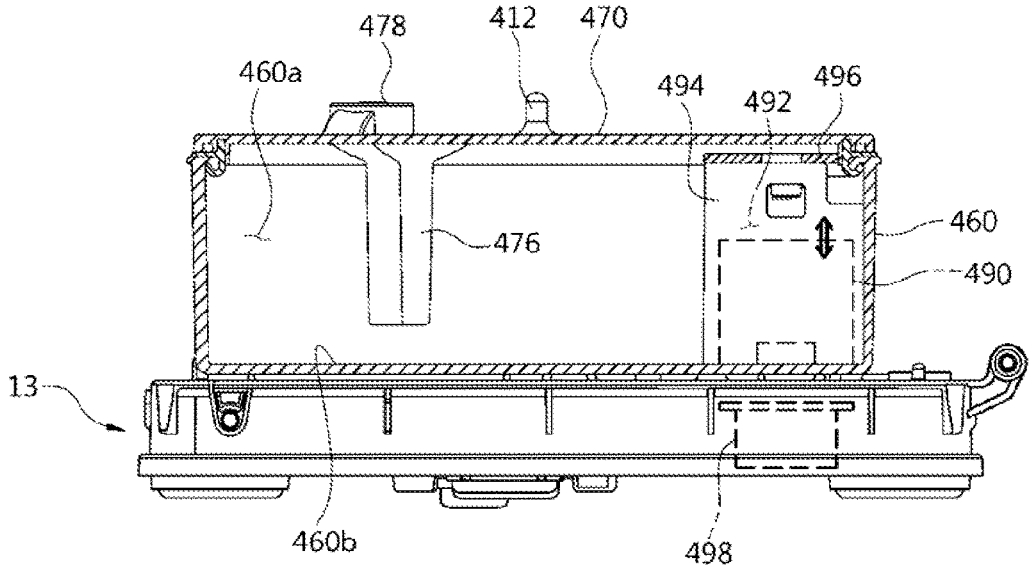
FIG. 15 is a view of a water level sensor of the water tank in the air conditioner according to an embodiment of the present disclosure.

FIG. 15 is a view of a water level sensor of the water tank according to an embodiment of the present disclosure.

The storage case 460 may be provided therein with a water level sensor 490.

The water level sensor 490 is provided to be able to detect an amount of the condensate in the storage case 460. The water level sensor 490 is disposed inside the storage case 460, is provided with buoyancy so as to be able to be separated from the bottom 460*b* of the storage case 460 by the condensate. The water level sensor 490 moves in a sensor movement space 492 due to the buoyancy depending on the amount of the condensate. The sensor movement space 492 is provided to communicate with the storage space 460*a* such that the condensate can flow into the sensor movement space 492.

The storage case 460 may be provided with a sensor guide 494 for restraining leftward/rightward movement of the water level sensor 490 such that the water level sensor 490 can move in an upward/downward direction only. The sensor guide 494 serves as a partition between the storage space 460*a* and the sensor movement space 492 such that the water level sensor 490 does not depart from the sensor movement space 492 and the condensate can flow into the sensor movement space 492. Further, a movement restrict 496 is provided on an upper side of the water level sensor 490 so as to restrain the water level sensor 490 from moving beyond a given height.

The base 13 may be provided with a sensor detector 498 so as to correspond to the water level sensor 490. The sensor detector 498 may be provided with magnetism. When the water level sensor 490 floats due to the buoyancy of the condensate rising up in the storage case 460, an amount of the condensate in the storage case 460 is detected due to a change in magnetic force between the water level sensor 490 and the sensor detector 498. When the storage space 460*a* reaches a high water level, the sensor detector 498 sends an electric signal to the control unit 70 in order to stop the operation of the air conditioner 1 such that the condensate is no longer generated. Conversely, the water level sensor 490 may be provided with magnetism such that the sensor detector 498 detects a magnetic force. This will do if the water level of the storage space 460*a* can be detected.

Hereinafter, a configuration for sensing movement or operation of the air conditioner according to an embodiment of the present disclosure will be described.

Figure 16A:
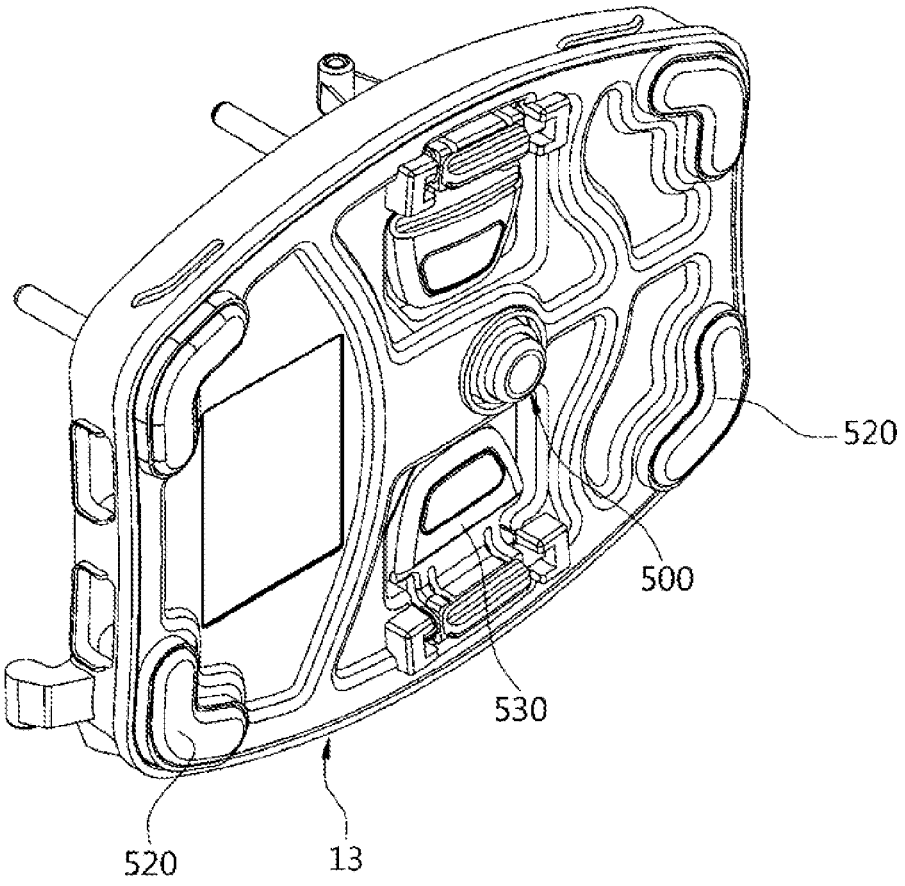
FIGS. 16A and 16B are views of the base and a movement sensing unit according to an embodiment of the present disclosure.
Figure 16B:
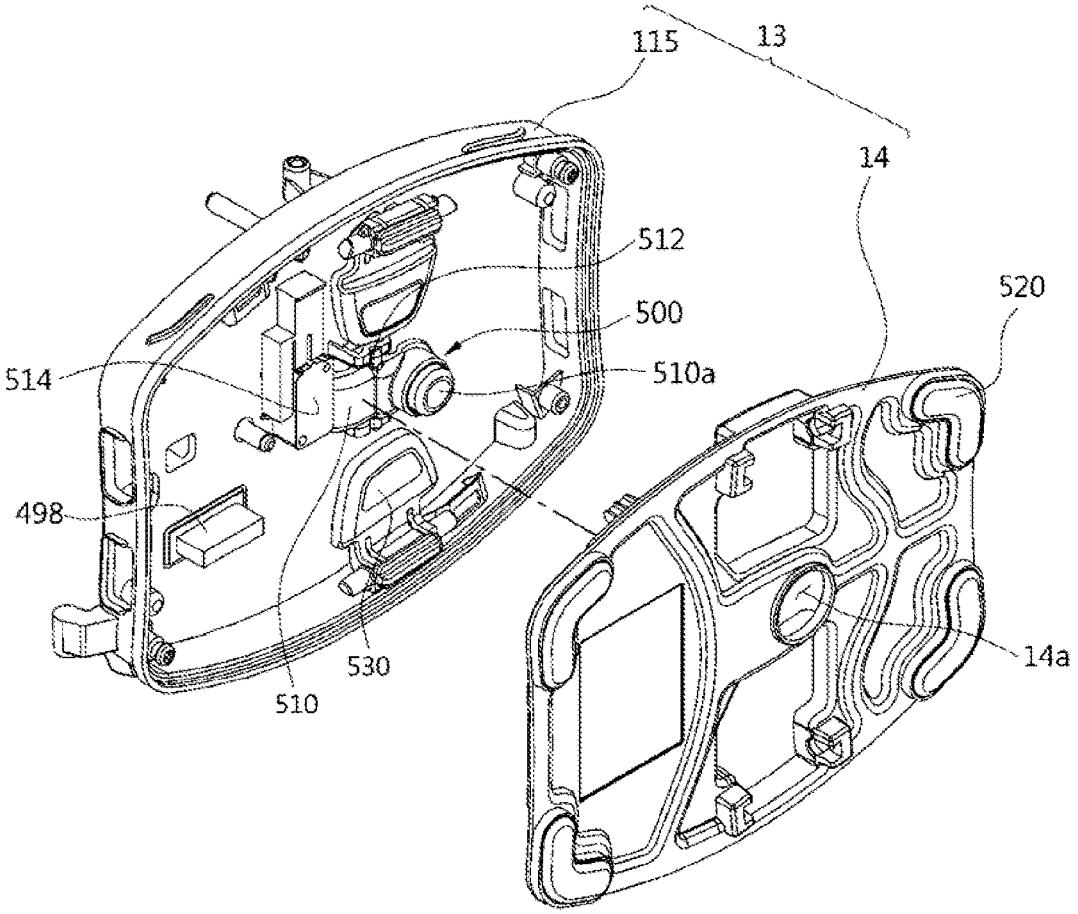
Figure 17A:
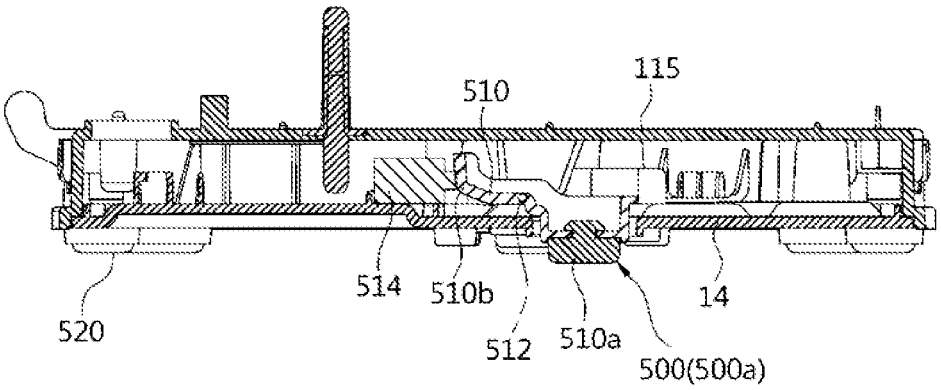
FIGS. 17A and 17B are views of an operation of the movement sensing unit according to an embodiment of the present disclosure.
Figure 17B:
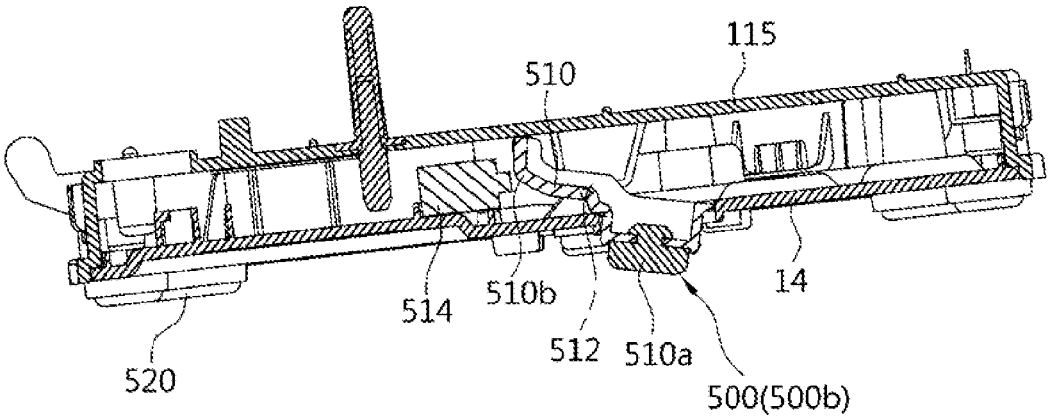

FIGS. 16A and 16B are views of the base and a movement sensing unit according to an embodiment of the present disclosure, and FIGS. 17A and 17B are views of an operation of the movement sensing unit according to an embodiment of the present disclosure.

When the air conditioner 1 falls or moves to and stays at another place during the operation of the air conditioner 1, the operation of the air conditioner 1 is restrained by the movement sensing unit 500. This movement sensing unit 500 will be described in more detail below.

The base 13 has at least one anti-slip part 520 disposed to prevent the air conditioner 1 from sliding during operation. The anti-slip part 520 is formed to protrude downward from the base 13 so as to come into contact with the floor, and prevents the air conditioner 1 from sliding. The anti-slip part 520 is not limited to the layout and material described herein. In the present embodiment, the anti-slip parts 520 are formed of an elastic material, and are widely disposed along a circumference of the base 13 so as to stably support the air conditioner 1 from the floor.

The base 13 has at least one leg part 530 disposed to prevent the air conditioner 1 from falling during the operation. The leg part 530 is provided for the base 13 so as to come into contact with the floor. The leg part 530 is folded to be disposed on the bottom of the base 13 when not used, and is unfolded when used so as to stably support the air conditioner 1. In an embodiment of the present disclosure, a pair of leg parts 530 are provided to be disposed in the leftward/rightward direction in which the air conditioner 1 is relatively narrower than in the forward/backward direction.

The base 13 may include the movement sensing unit 500.

When the base 13 is separated from the floor, the movement sensing unit 500 detects this, and sends a signal to the control unit 70. The operation of the air conditioner 1 is stopped by the control unit 70.

The movement sensing unit 500 has a unit rotational shaft 512 in parallel with the bottom of the base 13 such that an end thereof can rotate in the upward/downward direction.

The movement sensing unit 500 includes a unit body 510 whose opposite ends are provided to move up and down relative to the unit rotational shaft 512, a floor contact part 510*a* that is provided at one end of the unit body 510 so as to come into contact with the floor, and a switch operating part 510*b* that is provided at the other end of the unit body 510 and operates a microswitch 514.

The base 13 includes a base cover 14 and a base body 115. The base cover 14 is formed with a movement hole 14*a* such that the floor contact part 510*a* can move up and down. The movement sensing unit 500 is disposed between the base cover 14 and the base body 115, and may be rotatably disposed at the base body 15.

As in FIG. 17A, the movement sensing unit 500 is provided to move to a normal position 500*a* at which, with the unit rotational shaft 512 used as a fulcrum, the floor contact part 510*a* is in contact with the floor, and the switch operating part 510*b* turns on the microswitch 514. As in FIG. 17B, the movement sensing unit 500 is provided to move to a detection position 500*b* at which, with the unit rotational shaft 512 used as a fulcrum, the floor contact part 510*a* is separated from the floor, and the switch operating part 510*b* turns off the microswitch 514.

Hereinafter, a method of controlling the air conditioner according to an embodiment of the present disclosure will be described.

In general, the air conditioner 1 has a load determined by a difference between an actual indoor temperature and a setting temperature of a user in order to control a temperature in the entire indoor space. However, the air conditioner 1 in an embodiment of the present disclosure is provided similar to a personal air conditioner 1 such that cooled air or heated air is locally applied only to a part of an air-conditioning space, instead of cooling or heating the entire air-conditioning space. As such, a target air volume is set instead of setting a target temperature, and an operating frequency of the compressor 20 may be controlled to be suitable for the set target air volume. Thereby, the air conditioner 1 is operated with the same power input.

As the compressor 20 of the present disclosure, a capacity controlled compressor may be used. An example of the capacity controlled compressor may include, for instance, an inverter compressor. Even when all components have the same capability in a refrigeration cycle, a load may vary depending on an operating environment such as an ambient temperature, ambient conditions, and so on. When high load and much capability are required, the inverter compressor increases the operating frequency, which results in increasing the number of revolutions and the capability of the compressor 20. In contrast, when the load is low, the inverter compressor reduces the operating frequency, which results in reducing the number of revolutions and the capability of the compressor 20.

In general, if the operating frequency of the compressor 20 is increased with no change in the other components, the capability of the compressor 20 is increased, and power input is also increased. Further, if the air volume for the evaporator 50 is increased with no change of the other components, a temperature of the discharged air is increased, and cooling efficiency is reduced.

In the state in which the components of the refrigeration cycle are not changed, the power input is increased when a load is increased, whereas the power input is decreased when a load is decreased. The power input refers to the total power input that is consumed by all power consumption components constituting the air conditioner 1. For example, the power input may include input that is consumed by the compressor 20, the motor for the blower, and the control unit 70. Especially, the power input of the compressor 20 accounts for a very high percentage of the total power input, and variation thereof is great. Thus, the power input of the compressor 20 is a most important factor that controls the power input of the air conditioner 1.

Further, the power input of the compressor 20 increases in proportion to the operating frequency, but it has a great difference according to an operating pressure or temperature in spite of the same frequency. The operating pressure is determined by efficiency of the condenser 30, and the efficiency of the condenser 30 varies according to an air volume of the second ventilation fan 222. That is, when the air volume is reduced, the pressure is abruptly raised. In the result, the power input of the compressor 20 is increased when the operating frequency is high or when the air volume of the second ventilation fan 222 is small.

In the present disclosure, the capacity controlled inverter compressor is used as the compressor 20, and the compressor 20, the number of revolutions of which can be controlled, is used to enable a user to select a desired air volume of the air conditioner 1. Further, a consumer is adapted to select only a desired air volume in order to improve the convenience of use from the viewpoint of a user who uses the air conditioner 1. For example, when the user sets (or selects) the air volume, the compressor 20 is controlled to select and operate the number of revolutions of the compressor 20 in an optimum state according to the set air volume. That is, when the air volume is selected, then the compressor 20 is controlled such that the operating frequency thereof is changed. In the result, the air conditioner 1 is designed to be operated in a state in which the power input is approximately constant.

Further, in the present disclosure, a rotational speed of the first ventilation fan 122 for sending air around the evaporator 50 and a rotational speed of the second ventilation fan 222 for sending air around the first ventilation fan 122 and the condenser 30 cooperate with each other. To be more specific, the rotational speed (air volume) of the second ventilation fan 222 cooperates with the rotational speed (air volume) of the first ventilation fan 122. Thus, when the user sets the air volume of the first ventilation fan 122 to obtain a desired air volume, the first ventilation fan 122 is rotated at the air volume set by the user, and thus the second ventilation fan 222 is also rotated at the same air volume as the first ventilation fan 122. For example, if the air volume set by the user is high, the first ventilation fan 122 is rotated at a high speed and sends a strong wind, and the second ventilation fan 222 is also rotated at a high speed and sends a strong wind. In contrast, if the air volume set by the user is low, the first ventilation fan 122 is rotated at a relatively low speed and sends a weak wind, and the second ventilation fan 222 is also rotated at a relatively high speed and sends a weak wind.

Figure 18:
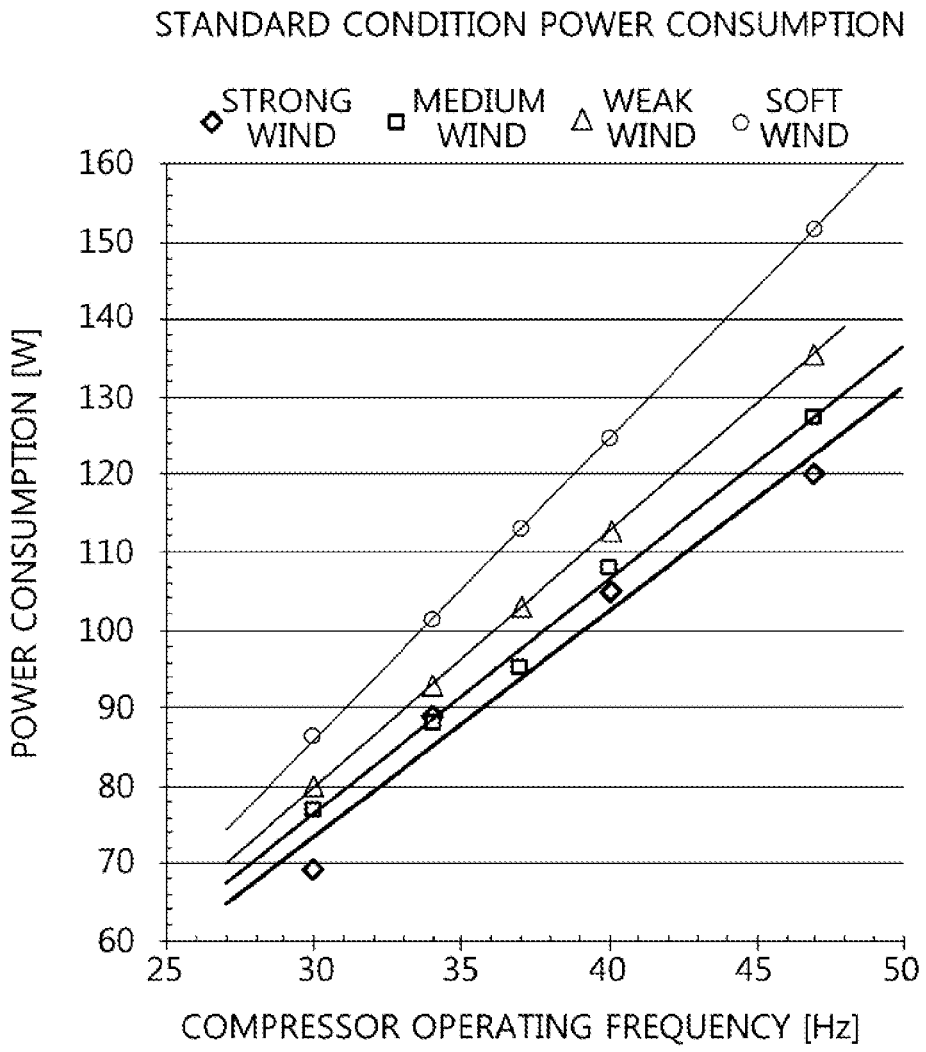
FIG. 18 is a graph of a relation between power consumption, ventilation intensity, and an operating frequency of a compressor in the air conditioner according to an embodiment of the present disclosure.

Table 1 represents a relation between the air volume and the power input according to the change of the operating frequency. Table 1 is shown in a graph as in FIG. 18. Items in the rows include wind intensities, and items in the columns include operating frequencies of a compressor.

TABLE 1

| | Strong wind | Medium wind | Weak wind | Soft wind |
|---|---|---|---|---|
| 30 | 69.0 | 76.6 | 80.0 | 86.1 |
| 34 | 88.7 | 87.9 | 92.7 | 101.3 |
| 37 | 94.9 | 95.0 | 103.0 | 113.2 |
| 40 | 105.0 | 108.0 | 112.7 | 124.7 |
| 47 | 120.0 | 127.0 | 135.6 | 151.8 |

It can be found that, for example, when the air conditioner is operated with the power input limited to 120 W, an increase in the operating frequency of the compressor 20 at the same air volume results in an increase in the power input. Further, it can be found that, when the air volume is low, the power input is increased compared to when the air volume is high. To sum up, when the operating frequency exceeds 39 Hz in the state of a very low air volume, the power input exceeds 120 W. When the operating frequency exceeds 46 Hz in the case of a high air volume, the power input exceeds 120 W.

Therefore, when a horizontal line is drawn rightwards at a point where the power input is 120 W, it has an intersection with a line according to each air volume. The operating frequency of the compressor 20 at this intersection is a necessary operating frequency of the compressor 20 at the corresponding air volume.

Figure 19:
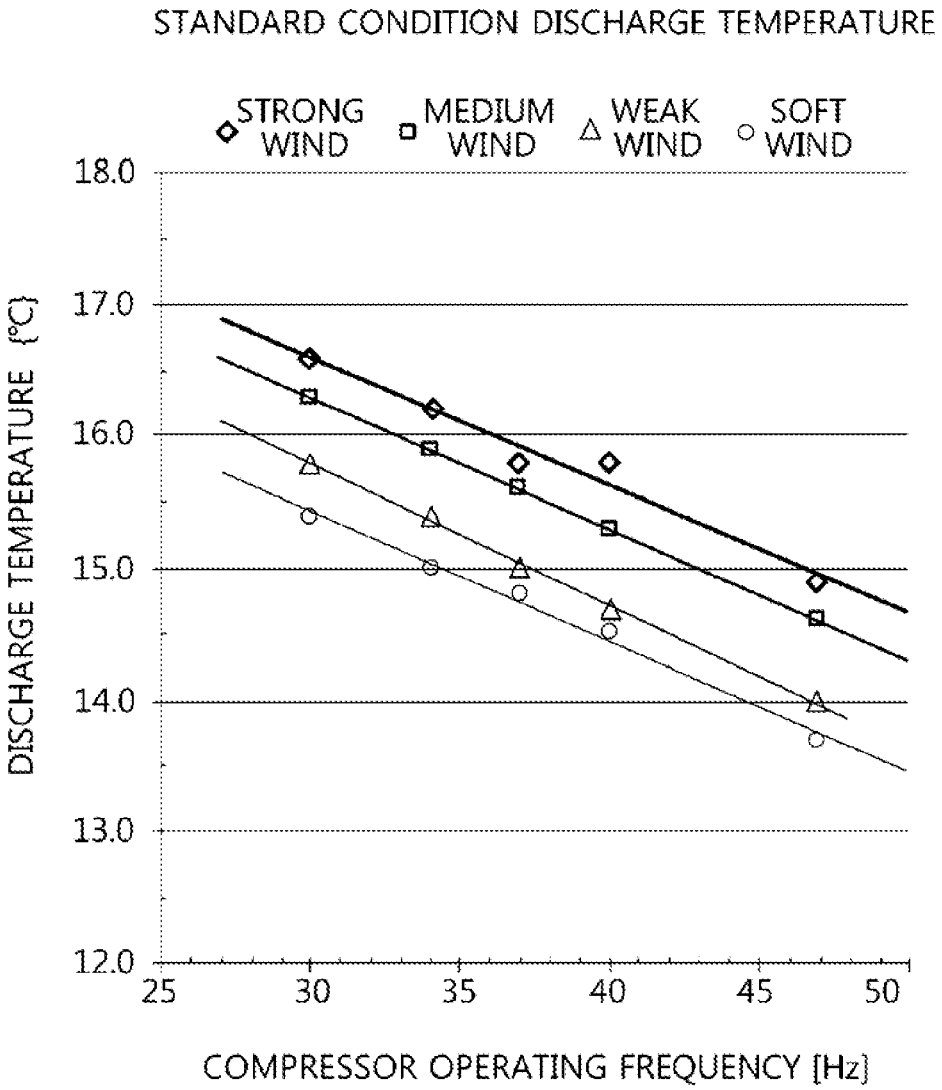
FIG. 19 is a graph of a relation between a discharge temperature at a first discharge port, ventilation intensity, and an operating frequency of a compressor in the air conditioner according to an embodiment of the present disclosure.

Table 2 represents a relation between the air volume and a temperature of air discharged from the first discharge port 104 depending on a change in operating frequency. Table 2 is shown in a graph as in FIG. 19. Items of the transverse row are intensities of a wind, and items of the longitudinal column are operating frequencies of a compressor.

TABLE 2

| | Strong wind | Medium wind | Weak wind | Soft wind |
|---|---|---|---|---|
| 30 | 16.6 | 16.3 | 15.8 | 15.4 |
| 34 | 16.2 | 15.9 | 15.4 | 15.0 |
| 37 | 15.8 | 15.6 | 15.0 | 14.8 |
| 40 | 15.8 | 15.3 | 14.7 | 14.5 |
| 47 | 14.9 | 14.6 | 14.0 | 13.7 |

When the operating frequency of the compressor 20 is increased, the capability is increased. As such, if the air volume is the same, the temperature of the air discharged from the first discharge port 104 is lowered. Further, when the operating frequency of the compressor 20 is the same, and the air volume is increased, the temperature of the air discharged from the first discharge port 104 is increased.

In the result, when the compressor 20 is operated such that the power input is kept constant, the temperature of the air discharged from the first discharge port 104 can be always kept similar, and a deviation between the discharge temperatures according to operating conditions can be greatly reduced.

Further, when the compressor 20 is operated such that the power input is kept constant, the air conditioner 1 can be operated in a stable power supply-demand environment by restricting the actual total power input within limited conditions of the maximum power input required of the air conditioner 1. Here, the limited conditions of the maximum power input may be either limited regulations of a power consumption amount or rated power of a power supply (i.e., rated power output to the air conditioner 1 at the power supply). As described above, since the power input of the compressor 20 accounts for the very high percentage of the total power input, and the variation thereof is very great, the power input of the compressor 20 is the most important factor that controls the power input of the air conditioner 1. Thus, assuming that the power inputs of the power consumption components other than the compressor 20 have a fixed value that is small in change and intensity, the total power input of the air conditioner 1 can be constantly maintained only by keeping the power input of the compressor 20 constant. In constantly maintaining the total power input of the air conditioner 1, it is natural to consider the power inputs of the power consumption components other than the compressor 20.

When the compressor 20 is the inverter compressor, it is initially operated at an operating frequency of about 20 Hz. When the operating frequency reaches a set operating frequency while being gradually increased, the operating frequency is fixed. The compressor 20 is operated at the fixed operating frequency. This is intended to stably operate the compressor 20 because the compressor 20 may undergo an excessive load when the compressor 20 is operated at a high operating frequency from the beginning.

During the operation of the compressor 20, when a temperature of a refrigerant discharged from the compressor 20 reaches 78° C., the operating frequency is fixed in this state without a further increase. If the temperature of the discharged refrigerant rises to 82° C. even in this state, the power input exceeds 120 W. As such, when the temperature of the discharged refrigerant arrives at 73° C., the operating frequency is reduced. In spite of an instruction to reduce the operating frequency, if the temperature of the refrigerant discharged from the compressor 20 continues to rise to 87° C. without a drop, the compressor 20 is stopped. When the compressor 20 is stopped, all functions are stopped, and the operation is restarted from the beginning. This may occur when the indoor temperature is raised beyond an allowed range, when the filter members 106 and 206 are covered in dust to reduce the air volume, or when the first and second discharge ports 104 and 204 are clogged to reduce the air volume.

To sum up, as shown in Table 3 below, when the set air volumes are "high," "medium," "low," and "very low," if the operating frequencies of the compressor 20 are set to 47, 40, 37, and 34, the power inputs are 120 W, 108.0 W, 103.0 W, and 101.3 W. It can be found that the power inputs are maintained at 120 W or less. From the viewpoint of the temperature of the discharged air, it can be found that, when the set air volumes are "high," "medium," "low," and "very low," the operating frequencies of the compressor 20 are set to 47, 40, 37, and 34, and thereby the temperatures of the discharged air are 14.9° C., 15.3° C., 15.0° C., and 15.0° C. and are maintained almost constant. In the result, the power input is stably maintained within the limited intensity (e.g., 120 W) while the air volume set by the user are maintained with no change, and the temperature of the discharged air can also be kept constant with no change.

TABLE 3

| | Strong wind | Medium wind | Weak wind | Soft wind |
|---|---|---|---|---|
| 30 | | | | |
| 34 | | | | 101.3 |
| 37 | | | 103.0 | |
| 40 | | 108.0 | | |
| 47 | 120.0 | | | |

TABLE 4

| | Strong wind | Medium wind | Weak wind | Soft wind |
|---|---|---|---|---|
| 30 | | | | |
| 34 | | | | 15.0 |
| 37 | | | 15.0 | |
| 40 | | 15.3 | | |
| 47 | 14.9 | | | |

Figure 20:
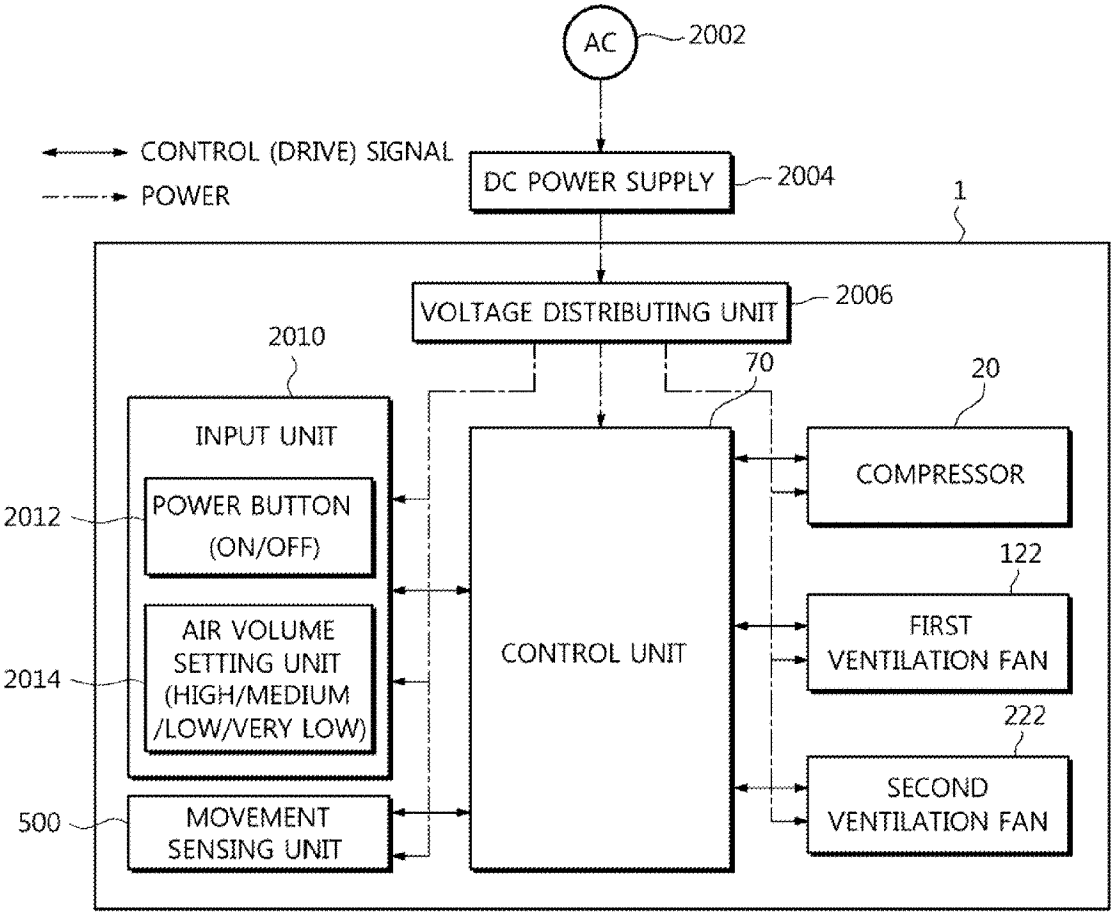
FIG. 20 is a view illustrating a control system of the air conditioner according to an embodiment of the present disclosure.

FIG. 20 is a view illustrating a control system of the air conditioner according to an embodiment of the present disclosure. As illustrated in FIG. 20, alternating current (AC) power supplied from an AC power supply 2002 is converted into a direct current (DC) by a DC power supply 2004, and then is supplied to the air conditioner 1. The DC power supply 2004 may be a DC adaptor acting as a separate device independent of the air conditioner 1.

In the air conditioner 1, a voltage distributing unit 2006 converts a voltage (e.g., 12 V or 24 V) output from the DC power supply 2004 into various voltages required from respective components of the air conditioner 1, and supplies the converted voltages. For example, the compressor 20, the first ventilation fan 122, and the second ventilation fan 222 can be supplied with 12 V or 24 V with no change, but the control unit 70, the input unit 2010, and the movement sensing unit 500, all of which require high voltage, can be supplied with 5 V or 3.3 V that is relatively low voltage.

The input unit 2010 may include a power button 2012 and an air volume setting unit 2014. The power button 2012 is intended to enable a user to carry out on/off control of the air conditioner 1. When the power button 2012 is turned on, the air conditioner 1 is initialized in an operable state while being supplied with the power. When the power button 2012 is turned off, the air conditioner 1 is not supplied with the power and stops all operations. The air volume setting unit 2014 is intended to enable a user to set the air volume (e.g., rotational speed) of the first ventilation fan 122 of the air conditioner 1. The first ventilation fan 122 is disposed between the first discharge port 104 and the evaporator 50, and discharges cooled air around the evaporator 50 (or heated air when operated as the condenser) through the first discharge port 104. The setting of the air volume may be divided into high/medium/low/very low, but it is not limited to such division. The setting of the air volume may be divided in a more simplified or complicated way, and be called another type of name.

The movement sensing unit 500 detects whether the air conditioner 1 falls while being operated or moving to another place, and informs the control unit 70 of the detected result in order to restrict the operation of the air conditioner 1.

The control unit 70 controls overall operations of the air conditioner 1. Especially, the control unit 70 controls the operating frequency of the compressor 20 such that the power input of the air conditioner 1 (or the power input of the compressor 20) does not exceed a preset limit while maintaining the air volume set by the air volume setting unit 2014. To this end, the control unit 70 secures data on the relation between the air volume and the operating frequency as shown in Tables 1 to 4 described above in a form of a lookup table, and controls the operating frequency of the compressor 20 which corresponds to the set air volume with reference to the secured data. A control method performed by such a control unit 70 will be described below with reference to FIG. 21.

Figure 21:
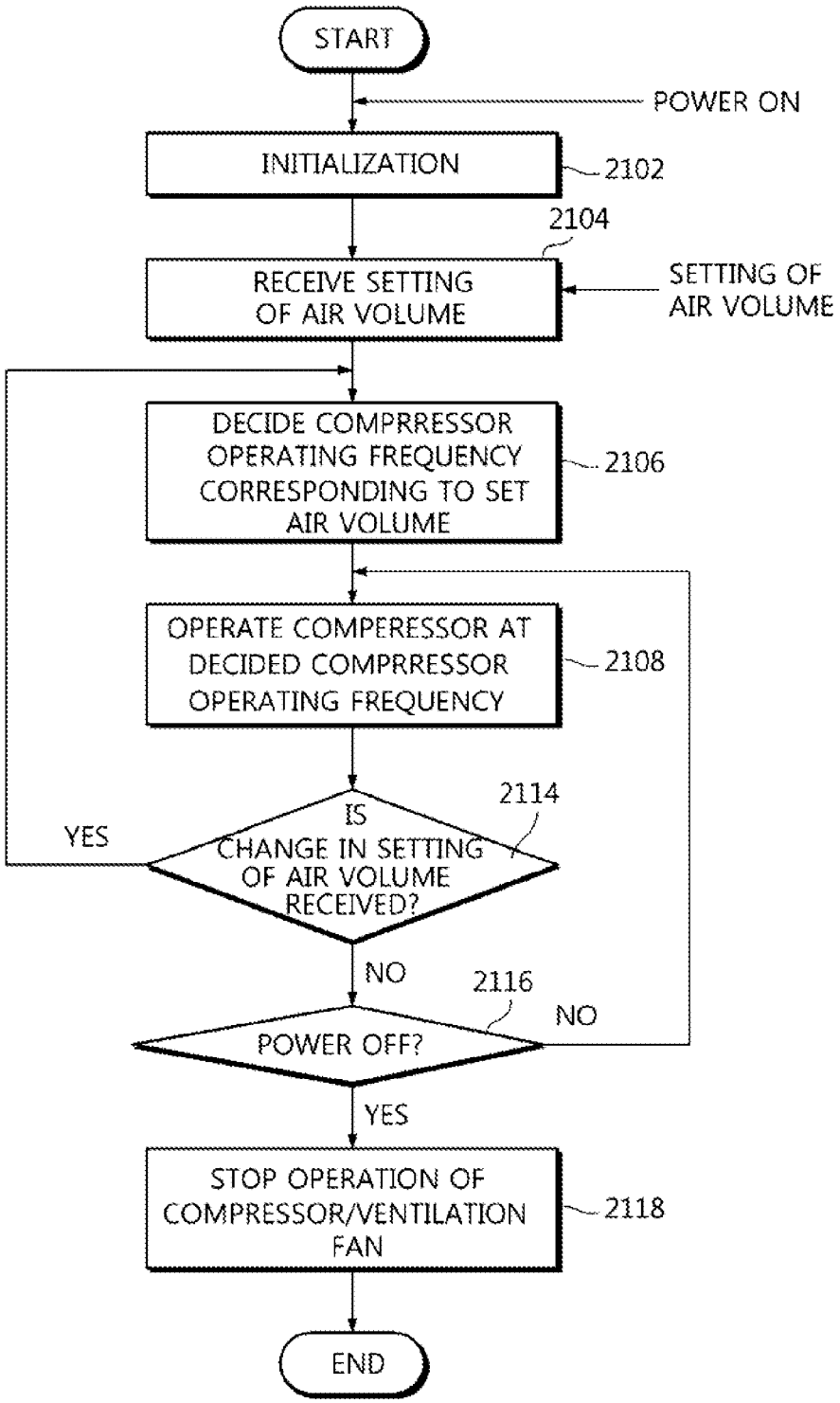
FIG. 21 is a view illustrating a first embodiment of a control method of the air conditioner according to an embodiment of the present disclosure.

FIG. 21 is a view illustrating a first embodiment of a control method of the air conditioner according to an embodiment of the present disclosure. As illustrated in FIG. 21, a user operates the power button 2012 to power on the air conditioner 1, and thus the air conditioner 1 is initialized (S2102). After the initialization, when the user operates the air volume setting unit 2014 to set an air volume, the control unit 70 receives the setting of the air volume from the air volume setting unit 2014 (S2104).

The control unit 70 decides an operating frequency of the compressor 20 which corresponds to the set air volume (S2106). To this end, the control unit 70 decides the operating frequency of the compressor 20 which corresponds to the set air volume with reference to the lookup table representing the data on the relation between the air volume and the operating frequency as shown in Tables 1 to 4 described above. Here, the control unit 70 decides the operating frequency of the compressor 20 such that power input does not exceed a preset maximum value (e.g., 120 W) while maintaining the air volume set by the user. When the operating frequency of the compressor 20 is decided, the control unit 70 operates the compressor 20 at the decided operating frequency so as to enable cooling/heating.

When a change in the set air volume is received while the compressor 20 is operated at one operating frequency decided in this way ("Yes" of S2114), the process proceeds to S2106, and a new operating frequency of the compressor 20 which corresponds to a newly set (or changed) air volume is decided. In contrast, when a change in the set air volume is not received while the compressor 20 is operated at one operating frequency ("No" of S2114), it is checked whether or not to power off the air conditioner (S2116). When the air conditioner is not powered off ("No" of S2116), the compressor 20 continues to be operated at a current operating frequency (S2108).

When the air conditioner is powered off ("Yes" of S2116), the components that are in operation, such as the compressor 20, the first ventilation fan 122, and the second ventilation fan 222, are stopped (S2118).

In this way, according to the control method of the air conditioner 1 according to an embodiment of the present disclosure, the compressor 20 is operated at the operating frequency corresponding to the set air volume. Thereby, the power input can be restricted to a preset value or less while the set air volume is maintained. This means that the power consumption amount of the air conditioner 1 is restricted to a desired value or less without changing the set air volume of the user, and thereby efficient power consumption control can be performed.

Figure 22:
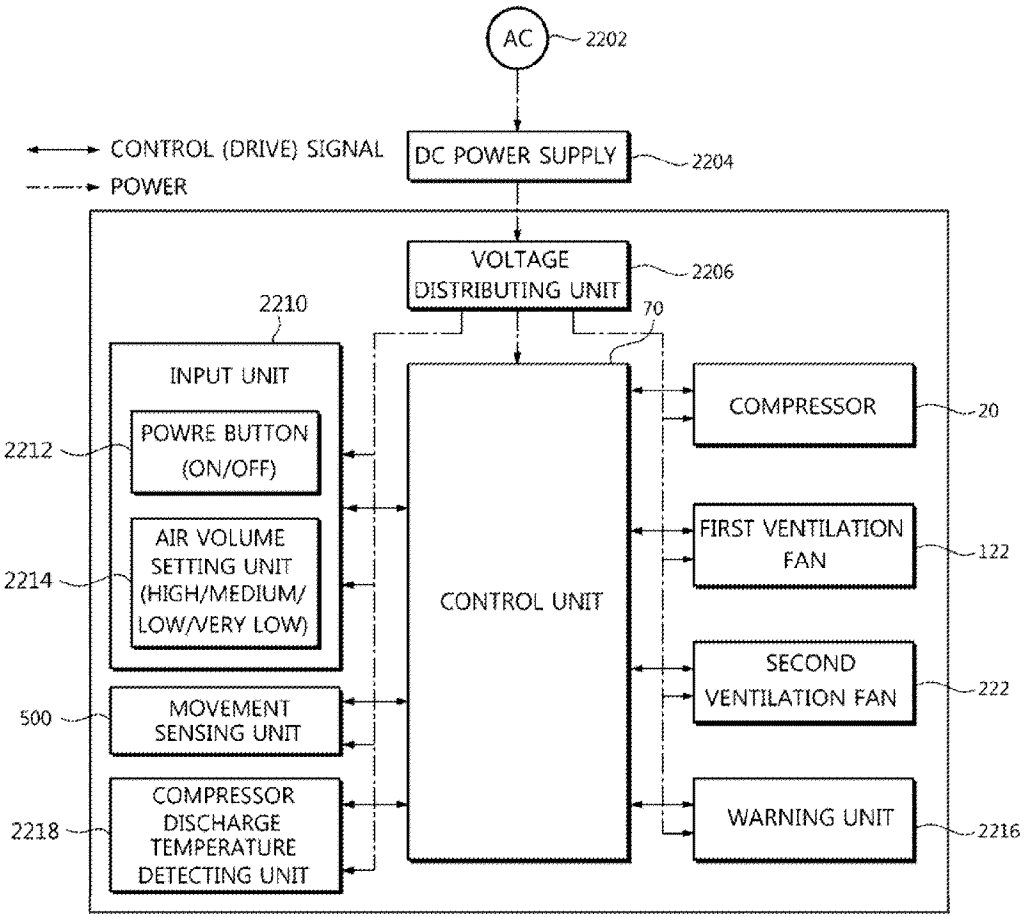
FIG. 22 is a view illustrating another control system of the air conditioner according to an embodiment of the present disclosure.

FIG. 22 is a view illustrating another control system of the air conditioner according to an embodiment of the present disclosure. As illustrated in FIG. 22, AC power supplied from an AC power supply 2202 is converted into a DC by a DC power supply 2204, and then is supplied to the air conditioner 1. The DC power supply 2204 may be a DC adaptor acting as a separate device independent of the air conditioner 1.

In the air conditioner 1, a voltage distributing unit 2206 converts a voltage (e.g., 12 V or 24 V) output from the DC power supply 2204 into various voltages required from respective components of the air conditioner 1, and supplies the converted voltages. For example, the compressor 20, the first ventilation fan 122, and the second ventilation fan 222 can be supplied with 12 V or 24 V with no change, but the control unit 70, the input unit 2210, and the movement sensing unit 500, all of which require high voltage, can be supplied with 5 V or 3.3 V that is relatively low voltage.

The input unit 2210 may include a power button 2212 and an air volume setting unit 2214. The power button 2212 is intended to enable a user to carry out on/off control of the air conditioner 1. When the power button 2212 is turned on, the air conditioner 1 is initialized in an operable state while being supplied with the power. When the power button 2212 is turned off, the air conditioner 1 is not supplied with the power and stops all operations. The air volume setting unit 2214 is intended to enable a user to set the air volume (e.g., rotational speed) of the first ventilation fan 122 of the air conditioner 1. The first ventilation fan 122 is disposed between the first discharge port 104 and the evaporator 50, and discharges cooled air around the evaporator 50 (or heated air when operated as the condenser) through the first discharge port 104. The setting of the air volume may be divided into high/medium/low/very low, but it is not limited to such division. The setting of the air volume may be divided in a more simplified or complicated way, and be called another type of name.

The movement sensing unit 500 detects whether the air conditioner 1 falls while being operated or moving to another place, and informs the control unit 70 of the detected result in order to restrict the operation of the air conditioner 1.

A warning unit 2216 is intended to announce a warning when the power input of the compressor 20 or the total power input of the air conditioner 1 reaches a preset maximum limit so as to enable a user to recognize the fact. The warning unit 2216 may include at least one of a light-emitting device, a display device, and an acoustic device.

A compressor discharge temperature detecting unit 2218 is intended to detect a temperature of a discharge-side refrigerant of the compressor 20. The compressor discharge temperature detecting unit 2218 may be a temperature sensor that is installed outside or inside a discharge-side pipe of the compressor 20 and detects the temperature of the refrigerant. Further, the compressor discharge temperature detecting unit 2218 may be a temperature sensor that detects a temperature at a place where the discharge temperature of the compressor 20 can be inferred.

The control unit 70 controls overall operations of the air conditioner 1. Especially, the control unit 70 controls the operating frequency of the compressor 20 such that the power input of the air conditioner 1 (or the power input of the compressor 20) does not exceed a preset limit while maintaining the air volume set by the air volume setting unit 2214. To this end, the control unit 70 secures data on the relation between the air volume and the operating frequency as shown in Tables 1 to 4 described above in a form of a lookup table, and controls the operating frequency of the compressor 20 which corresponds to the set air volume with reference to the secured data. Further, the control unit 70 further reduces the operating frequency of the compressor 20 first when the power input of the compressor 20 exceeds the preset limit, thereby making an attempt so that the power input of the compressor 20 is reduced within the preset limit. Nevertheless, if the power input of the compressor 20 exceeds the preset limit to reach a maximum limit, a power overload of the air conditioner 1 is prevented by shutdown (e.g., power off). A control method performed by such a control unit 70 will be described below with reference to FIGS. 23 and 24.

Figure 23:
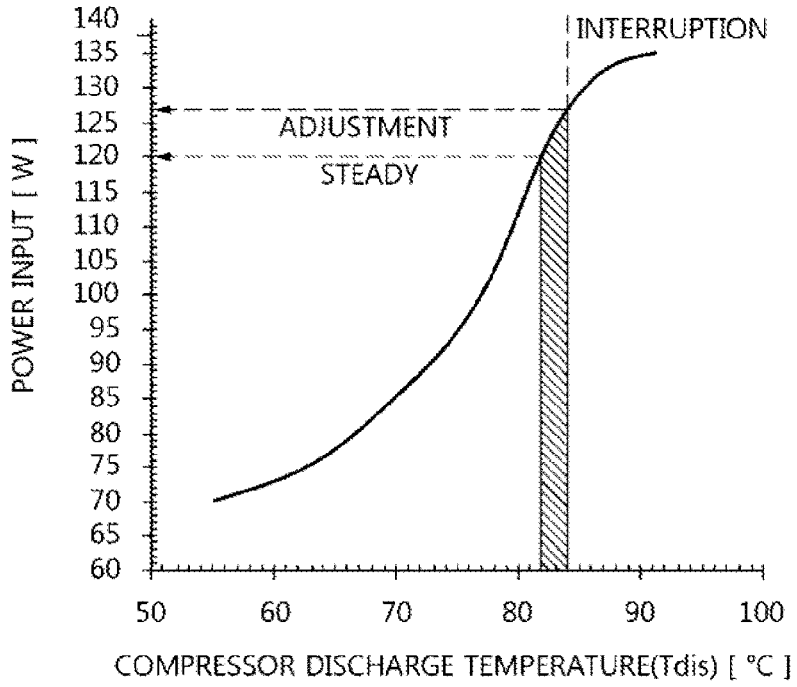
FIG. 23 is a view for describing a concept of power consumption control using a discharge temperature of the compressor in the air conditioner according to an embodiment of the present disclosure.
Figure 23:
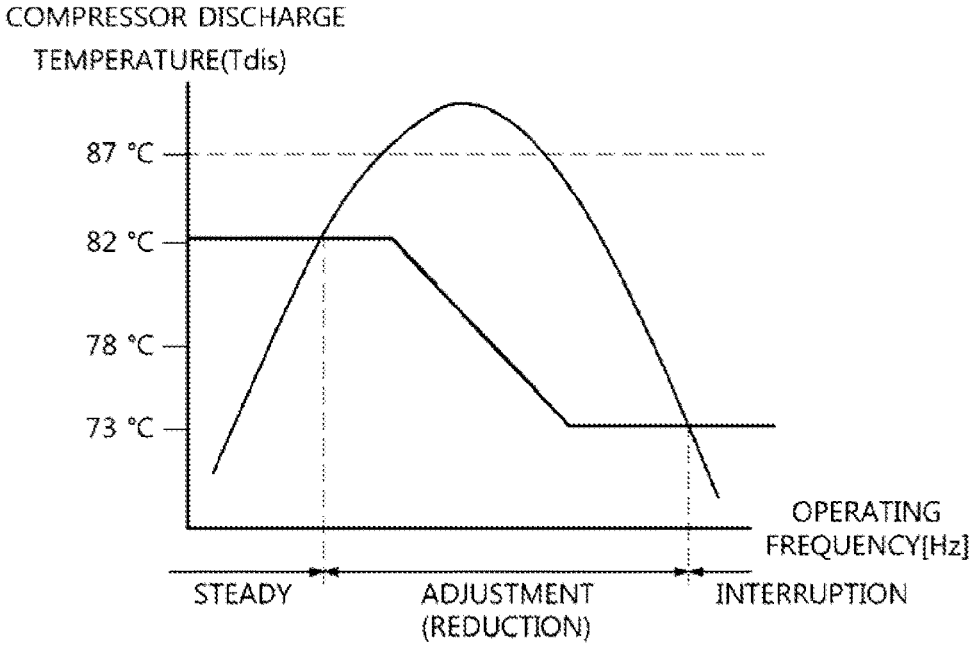

FIG. 23 is a view for describing a concept of power consumption control using a discharge temperature of the compressor in the air conditioner according to an embodiment of the present disclosure. FIG. 23(A) is a graph illustrating a relation between a discharge temperature Tdis and a power input of the compressor, and FIG. 23(B) is a graph illustrating a relation between the operating frequency and the discharge temperature Tdis of the compressor 20.

In the air conditioner 1 according to an embodiment of the present disclosure, the power input of the compressor 20 is detected from a compressor discharge temperature Tdis based on the fact that the compressor discharge temperature Tdis is increased in proportion to an increase in the power input of the compressor 20, and the operating frequency of the compressor 20 is controlled in consideration of the detected result. The reason the operating frequency of the compressor 20 is controlled in consideration of the compressor discharge temperature Tdis is as follows. When a user sets an air volume of the first ventilation fan 122, the compressor 20 is operated at an operating frequency corresponding to the set air volume. In this state, if the first discharge port 104 through which the cooled/heated air is discharged by the first ventilation fan 122 is clogged with dust or obstacles, the cooled/heated air is not smoothly discharged. In this case, although the air volume set by the user is fixed, the actual air volume is likely to be reduced. When the actual air volume of the first ventilation fan 122 is reduced, the power input of the compressor 20 is increased. As such, power consumption is increased, and the compressor discharge temperature Tdis is also increased. Thus, the fact that the compressor discharge temperature Tdis is increased with the set air volume of the first ventilation fan 122 fixed means that the actual air volume of the first ventilation fan 122 is reduced due to an influence of the dust or the obstacles, and the power input of the compressor 20 is increased. As such, this is detected to control the operating frequency of the compressor 20. Thereby, although the actual air volume of the first ventilation fan 122 is reduced, the power input of the compressor 20 is not excessively increased.

It can be found that, in FIGS. 23(A) and 23(B), the compressor discharge temperature Tdis is equal to or less than 82° C. in a section where the power input of the compressor 20 is equal to or less than 120 W. This section is referred to as a "steady" section. In the "steady" section, under the conclusion that the actual air volume of the first ventilation fan 122 is not reduced and is identical to the set air volume, the compressor 20 is operated at the operating frequency corresponding to the set air volume without changing the operating frequency of the compressor 20.

It can be found that, in FIGS. 23(A) and 23(B), the compressor discharge temperature Tdis exceeds 82° C. and is not more than 85° C. in a section where the power input of the compressor 20 exceeds 120 W and is no more than 127 W. This section is referred to as an "adjustment" section. In the "adjustment" section, under the conclusion that the actual air volume of the first ventilation fan 122 is reduced, the operating frequency of the compressor 20 is reduced to make an attempt so that the power input of the compressor 20 is reduced to fall within a range of 120 W or less. That is, the compressor exceeds the current target power input of 120 W, but the exceeding extent is not great. As such, an "adjustment" operation is performed to reduce the power input of the compressor 20 to a value less than 120 W by reducing the operating frequency of the compressor 20.

In spite of the attempt of such "adjustment" in the FIGS. 23(A) and 23(B), if the power input of the compressor 20 exceeds 125 W, it is determined through the attempt to reduce (i.e. the adjustment of) the operating frequency of the compressor 20 that it is difficult to reduce the power input of the compressor 20 to 120 W or less. Therefore, in this case, an "interruption" operation that stops the operations of the compressor 20 and the first ventilation fan 122 to announce a warning is performed.

Figure 24:
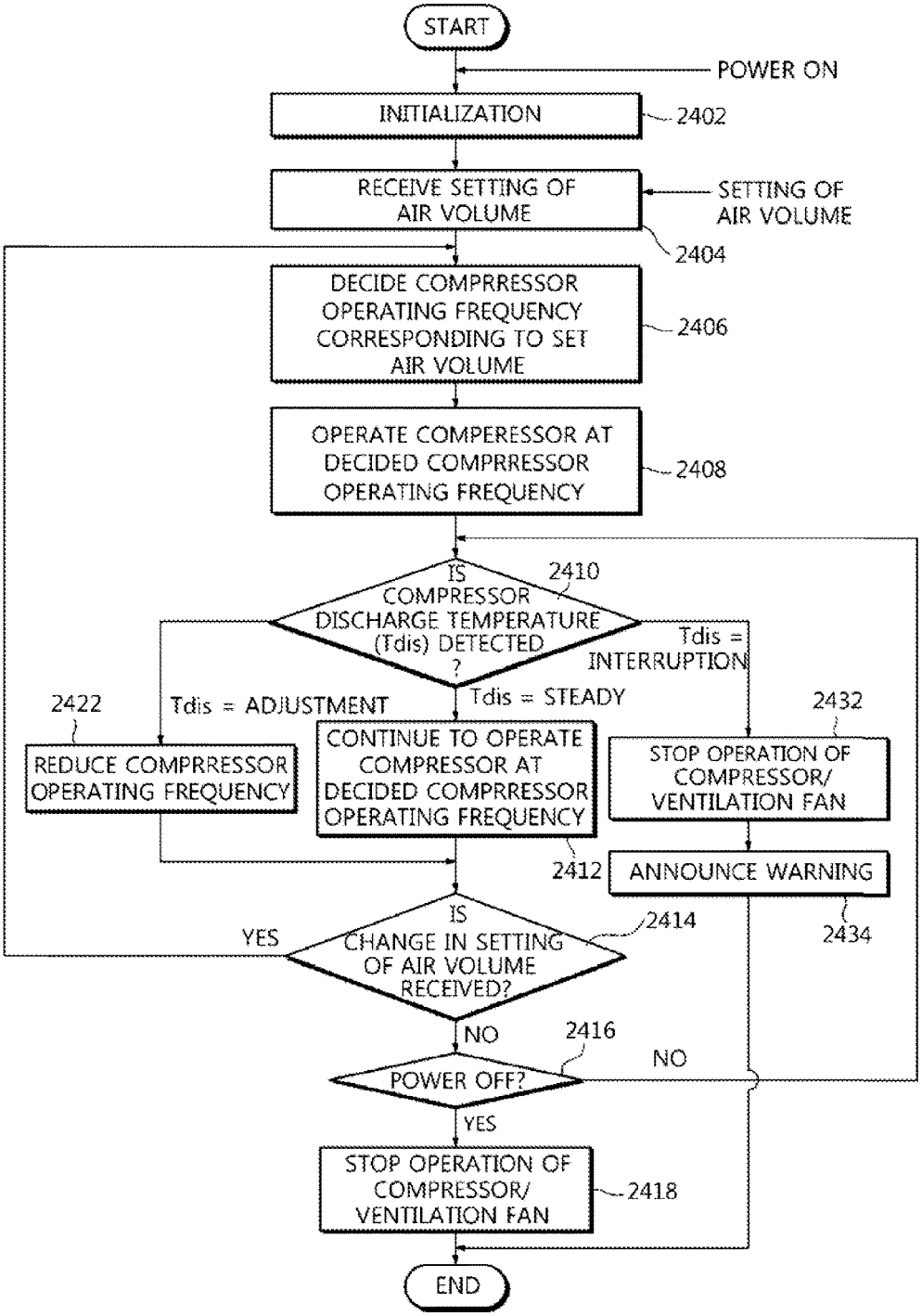
FIG. 24 is a view illustrating a second embodiment of a control method of the air conditioner according to an embodiment of the present disclosure.

FIG. 24 is a view illustrating a second embodiment of a control method of the air conditioner according to an embodiment of the present disclosure. As illustrated in FIG. 24, a user operates the power button 2012 to power on the air conditioner 1, and thus the air conditioner 1 is initialized (S2402). After the initialization, when the user operates the air volume setting unit 2014 to set an air volume, the control unit 70 receives the setting of the air volume from the air volume setting unit 2014 (S2404).

The control unit 70 decides an operating frequency of the compressor 20 which corresponds to the set air volume (S2406). To this end, the control unit 70 decides the operating frequency of the compressor 20 which corresponds to the set air volume with reference to the lookup table representing the data on the relation between the air volume and the operating frequency as shown in Tables 1 to 4 described above. Here, the control unit 70 decides the operating frequency of the compressor 20 such that power input does not exceed a preset maximum value (e.g., 120 W) while maintaining the air volume set by the user. When the operating frequency of the compressor 20 is decided, the control unit 70 operates the compressor 20 at the decided operating frequency so as to enable cooling/heating (S2408).

The control unit 70 detects a discharge temperature Tdis of the compressor 20 using the compressor discharge temperature detecting unit 2218 while the compressor 20 is operated at one operating frequency decided in this way (S2410). If the detected compressor discharge temperature Tdis is a temperature within a "steady" range (Tdis=steady), the compressor 20 continues to be operated at a currently decided operating frequency (S2412). That is, in this case, although the compressor 20 is operated at a current operating frequency within a steady range (less than 120 W of FIG. 23) within the power input of the compressor 20 is preset, no electrical overload occurs at the air conditioner 1, and thus the compressor 20 continues to be operated at the current operating frequency.

When a change in the set air volume is received while the compressor 20 is operated at the current operating frequency in this way ("Yes" of S2414), the process proceeds to S2406, and a new operating frequency of the compressor 20 which corresponds to a newly set (or changed) air volume is decided. In contrast, when a change in the set air volume is not received while the compressor 20 is operated at one operating frequency ("No" of S2414), it is checked whether or not to power off the air conditioner (S2416). When the air conditioner is not powered off ("No" of S2416), the process proceeds to the discharge temperature detecting process (S2410) of the compressor 20, and an operation corresponding to the discharge temperature of the compressor 20 is performed.

When the air conditioner is powered off ("Yes" of S2416), the components that are in operation, such as the compressor 20, the first ventilation fan 122, and the second ventilation fan 222, are stopped (S2418).

In the discharge temperature detecting process (S2410) of the compressor 20, when the detected compressor discharge temperature Tdis is a temperature within an "adjustment" range (Tdis=adjustment), the operating frequency of the compressor 20 is further reduced than the current operating frequency such that the power input of the compressor 20 is reduced (S2422). That is, in this case, the power input of the compressor 20 deviates from the preset steady range (less than 120 W of FIG. 23). As such, if the compressor is operated with no change, an electrical overload occurs at the air conditioner 1. Thus, the operating frequency of the compressor 20 is further reduced than the current operating frequency, and the power input of the compressor 20 is reduced. Thereby, the electrical overload is prevented from occurring at the air conditioner 1.

In the discharge temperature detecting process (S2410) of the compressor 20, when the detected compressor discharge temperature Tdis is a temperature within an "interruption" range (Tdis=interruption), the operations of the compressor 20, the first ventilation fan 122, and the second ventilation fan 222 are stopped (S2432), and a warning is given by the warning unit 2216 so as to enable a user to recognize the electrical overload state of the air conditioner 1 (S2434).

In this way, according to the control method of the air conditioner 1 according to an embodiment of the present disclosure, the compressor 20 is operated at the operating frequency corresponding to the set air volume. Thereby, the power input can be restricted to a preset value or less while the set air volume is maintained. This means that the power consumption amount of the air conditioner 1 is restricted to a desired value or less without changing the set air volume of the user, and thereby efficient power consumption control can be performed. Especially, it is detected through the discharge temperature of the compressor 20 in which of the "steady," "adjustment," and "interruption" states the power input of the compressor 20 is, and the operating frequency of the compressor 20 is controlled based on the detected result. Thereby, no electrical overload occurs at the air conditioner 1, and the power input can be efficiently controlled.

The methods according to the above-described example embodiments may be recorded in non-transitory computer-readable media including program instructions to implement various operations embodied by a computer or processor. The media may also include, alone or in combination with the program instructions, data files, data structures, and the like. The program instructions recorded on the media may be those specially designed and constructed for the purposes of the example embodiments, or they may be of the kind well-known and available to those having skill in the computer software arts. Examples of non-transitory computer-readable media include magnetic media such as hard disks, floppy disks, and magnetic tape; optical media such as CD ROM discs and DVDs; magneto-optical media such as optical discs; and hardware devices that are specially configured to store and perform program instructions, such as read-only memory (ROM), random access memory (RAM), flash memory, and the like.

Examples of program instructions include both machine code, such as produced by a compiler, and files containing higher level code that may be executed by the computer using an interpreter. The described hardware devices may be configured to act as one or more software modules in order to perform the operations of the above-described embodiments, or vice versa. The described methods may be executed on a general purpose computer or processor or may be executed on a particular machine such as the air conditioner described herein.

The air conditioner of the present disclosure can be made small and easily installed by improving a structure of the heat exchanger.

Further, a positional change or movement of the air conditioner is possible as needed, the air conditioner has convenience as a portable device.

Further, a structure and disposition of the heat exchanger are improved to increase heat exchange efficiency, and a cooling mode and a dehumidifying mode can be operated.

In addition, when used for a personal purpose or in a local space, the air conditioner can be controlled to efficiently use power consumption.

Although specific embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An air conditioner comprising:

a housing including:

a first portion including a first suction port and a first discharge port, a second portion including a second suction port and a second discharge port, and a partition separating the first portion of the housing from the second portion of the housing;

a compressor disposed in the housing and configured to compress a refrigerant;

a condenser disposed in the second portion of the housing and configured to condense the refrigerant compressed by the compressor into a liquid phase;

an expansion tube configured to expand the refrigerant condensed by the condenser to a low pressure state;

an evaporator disposed in the first portion of the housing and configured to evaporate the refrigerant expanded by the expansion tube to exchange heat with ambient air;

a watertank configured to store a condensate; and a tray assembly configured to discharge a condensate generated by the evaporator to the condenser and to discharge a condensate not evaporated by the condenser to the watertank, the tray assembly including:

a first tray having a water storage space configured to store the condensate generated from the evaporator, a second tray configured to receive the condensate from the first tray and to discharge the received condensate to the condenser, and a third tray disposed below the condenser and configured to collect condensate passing through the condenser.

2. The air conditioner according to claim 1, wherein:

the first tray is disposed below the evaporator and includes an open water conduit configured to collect the condensate generated by a heat exchange between the evaporator and the air introduced from an outside;

the second tray is disposed above the condenser and includes a supply space configured to store the condensate delivered from the first tray; and the third tray includes a discharge space configured to collect the condensate passing through the condenser.

3. The air conditioner according to claim 2, further comprising an auxiliary member disposed between the second tray and the condenser and configured to uniformly supply the condensate discharged from the second tray to the condenser.

4. The air conditioner according to claim 3, wherein the auxiliary member covers an upper portion of the condenser and is disposed between the condenser and the second tray under pressure and configured to uniformly disperse the condensate to the condenser.

5. The air conditioner according to claim 1, further comprising a handle disposed on a line passing through a center of gravity of the air conditioner, wherein the condenser and the evaporator have a center of gravity disposed below the handle.

6. The air conditioner according to claim 1, further comprising:

a first ventilation fan disposed in the first portion of the housing between the first discharge port and the evaporator; and a second ventilation fan disposed in the second portion of the housing between the second discharge port and the condenser, wherein the first discharge port, the first ventilation fan, the evaporator, and the first suction port are disposed in one row in the first portion of the housing, and the second discharge port, the second ventilation fan, the condenser, and the second suction port are disposed in the second portion of the housing in another row parallel to the one row.

7. The air conditioner according to claim 1, wherein the first discharge port and the second discharge port are disposed on opposing sides of the housing.

8. The air conditioner according to claim 1, wherein:

the first portion of the housing includes an evaporation channel extending from the first suction port to the first discharge port;

the second portion of the housing includes a condensation channel extending from the second suction port to the second discharge port; and the evaporation channel and the condensation channel extend in opposite directions from each other.

9. The air conditioner according to claim 1, wherein the second portion of the housing is disposed below the first portion of the housing, and main surfaces of the condenser are not parallel to main surfaces of the evaporator.

10. The air conditioner according to claim 1, further comprising a controller that is disposed in the second portion of the housing and configured to electrically control the air conditioner, wherein the second portion of the housing includes a condensation channel extending from the second suction port, into which air is introduceable from an outside, to the second discharge port to which the air in the second portion of the housing is dischargeable, and the condensation channel includes a first condensation channel that passes through the second suction port, the condenser, a ventilation fan, and the second discharge port, and a second condensation channel that passes through the second suction port, the controller, the ventilation fan, and the second discharge port.

11. An air conditioner comprising:

a housing comprising:

a first portion including a first suction port, a first discharge port, and an evaporator, and a second portion including a second suction port, a second discharge port, and a condenser;

a partition configured to prevent air in the first portion of the housing from being interchanged with air in the second portion of the housing; and a tray assembly including:

a first tray having a water storage space configured to store a condensate generated from the evaporator, a second tray configured to receive the condensate from the first tray and to discharge the received condensate to the condenser, and a third tray disposed below the condenser and configured to collect condensate passing through the condenser, wherein the first portion of the housing includes components configured to discharge air cooled by the air conditioner to an indoor environment and the second portion of the housing includes other components configured to provide air from an outdoor environment to be cooled by the components included in the first portion of the housing.

* * * * *